US008398198B2

(12) United States Patent
Murashima

(10) Patent No.: US 8,398,198 B2
(45) Date of Patent: Mar. 19, 2013

(54) IMAGE RECORDING APPARATUS

(75) Inventor: Hiroshi Murashima, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 379 days.

(21) Appl. No.: 12/706,364

(22) Filed: Feb. 16, 2010

(65) Prior Publication Data

US 2010/0245433 A1 Sep. 30, 2010

(30) Foreign Application Priority Data

Mar. 30, 2009 (JP) ..... 2009-082586

(51) Int. Cl.
*B41J 29/38* (2006.01)

(52) U.S. Cl. ..... 347/14; 347/9

(58) Field of Classification Search ..... 347/14, 347/9, 19, 5

See application file for complete search history.

(56) References Cited

U.S. PATENT DOCUMENTS

| | | | | |
|---|---|---|---|---|
| 7,637,584 | B2 * | 12/2009 | Takata | 347/19 |
| 7,658,487 | B2 * | 2/2010 | Yamashita et al. | 347/15 |
| 7,712,887 | B2 * | 5/2010 | Kadomatsu et al. | 347/101 |
| 2007/0076030 | A1 * | 4/2007 | Izuo | 347/9 |

FOREIGN PATENT DOCUMENTS

| | | |
|---|---|---|
| JP | 2004-106474 A | 4/2004 |
| JP | 2006-095816 | 4/2006 |
| JP | 2006-297666 A | 11/2006 |
| JP | 2007-136722 | 6/2007 |

OTHER PUBLICATIONS

Japanese Official Action dated Mar. 1, 2011 from related application JP 2009-082586.

* cited by examiner

*Primary Examiner* — Manish S Shah

(74) *Attorney, Agent, or Firm* — Scully, Scott, Murphy & Presser, P.C.

(57) ABSTRACT

An image recording apparatus including: a head having openings; a sheet-moving mechanism; a drive-data storage portion storing drive data; a converting section which converts the drive data such that an image position adjustment is changed; a first extracting section which extracts at least one opening whose number of ejections during the recording on at least one sheet of a first number based on unconverted drive data is smaller than a second number; a second extracting section which extracts at least one opening whose number of ejections during the recording on at least one sheet of a third number based on converted drive data is smaller than a fourth number; and a controller which controls the ejection such that a preliminary ejection from at least one opening extracted by the first and second extracting sections is performed upon recordings based on the unconverted drive data and the converted drive data.

15 Claims, 10 Drawing Sheets

IMAGE RECORDING APPARATUS

CROSS REFERENCE TO RELATED APPLICATION

The present application claims priority from Japanese Patent Application No. 2009-082586, which was filed on Mar. 30, 2009, the disclosure of which is herein incorporated by reference in its entirety.

BACKGROUND OF THE INVENTION

1. Field of the Invention

The present invention relates to an image recording apparatus such as an ink jet printer.

2. Description of the Related Art

In an image recording apparatus including a liquid ejection head configured to eject liquid droplets onto a recording medium, there is a problem such as ink-ejection failure including lowering of an ejection speed, non-ejection, and unevenness of an ejection direction of the liquid droplets from ejection openings from which the liquid has not been ejected for a long time. In order to restrain the ink-ejection failure, in a conventional technique, a dummy jet (i.e., a preliminary ejection) is performed on a sheet from nozzles in which the ejection has not been performed for a period equal to or longer than a predetermined length of time.

SUMMARY OF THE INVENTION

In this conventional technique, it is preferable to reduce an amount of ink used in the preliminary ejection as much as possible in order to reduce an amount of the ink unnecessarily consumed by the preliminary ejection on the sheet. On the other hand, in order to restrain the ink-ejection failure, it is preferable to increase an amount of the ink used in the preliminary ejection as much as possible by performing the preliminary ejection as frequently as possible. Thus, in the conventional technique, it is difficult to achieve both of the reduction of the ink amount in the preliminary ejection and the restraint of the ink-ejection failure.

This invention has been developed in view of the above-described situations, and it is an object of the present invention to provide an image recording apparatus capable of achieving both of reduction of a liquid amount in a preliminary ejection and restraint of ink-ejection failure.

The object indicated above may be achieved according to the present invention which provides an image recording apparatus comprising: a liquid-ejection head in which formed a plurality of liquid-ejection openings which are arranged in a first direction and through each of which liquid is ejected onto a recording medium; a moving mechanism configured to move the recording medium relative to the liquid-ejection head in a second direction which is perpendicular to the first direction; a drive-data storage portion configured to store drive data based on which the liquid-ejection head is driven; a drive-data converting section configured to convert the drive data such that an image position adjustment in which a position of an image formed on the recording medium by the liquid ejected from the liquid-ejection head on the basis of the drive data which has been converted is changed in the first direction with respect to an image formed on the recording medium by the liquid ejected from the liquid-ejection head on the basis of the drive data which has not been converted; a first ejection-opening extracting section configured to extract at least one liquid-ejection opening whose number of ejections of the liquid during the recording of the image on at least one recording medium of a first predetermined number on the basis of the drive data which has not been converted by the drive-data converting section is smaller than a second predetermined number among the plurality of liquid-ejection openings; a second ejection-opening extracting section configured to extract at least one liquid-ejection opening whose number of ejections of the liquid during the recording of the image on at least one recording medium of a third predetermined number on the basis of the drive data which has been converted by the drive-data converting section is smaller than a fourth predetermined number among the plurality of liquid-ejection openings, the recording of the image being performed successively before or successively after the recording of the image on the at least one recording medium of the first predetermined number; and an ejection controller configured to control the ejection of the liquid from the liquid-ejection head such that at least one preliminary ejection of the liquid from at least one liquid-ejection opening extracted by both of the first ejection-opening extracting section and the second ejection-opening extracting section is performed upon recording of the image on at least one of a plurality of the recording media which is subjected to both of the recording of the image on the at least one recording medium of the first predetermined number on the basis of the drive data which has not been converted by the drive-data converting section and the recording of the image on the at least one recording medium of the third predetermined number on the basis of the drive data which has been converted by the drive-data converting section.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which.

DESCRIPTION OF THE EMBODIMENTS

Hereinafter, there will be described embodiments of the present invention by reference to the drawings.

First Embodiment

Overall Construction of Printer

Figure 1:
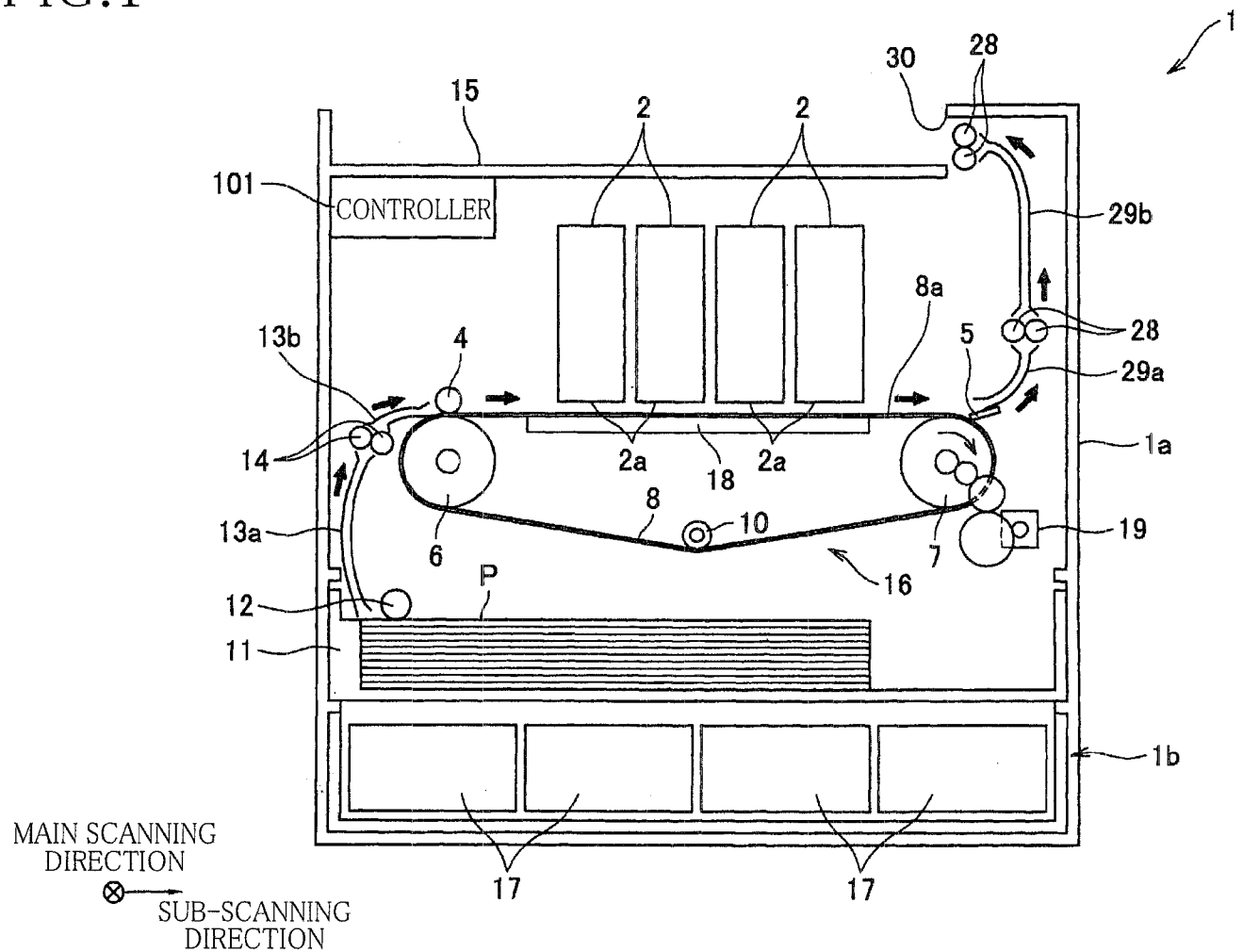
FIG. 1 is a side view of an internal structure of an ink-jet printer which is an image recording apparatus as an embodiment of the present invention.
Figure 2:
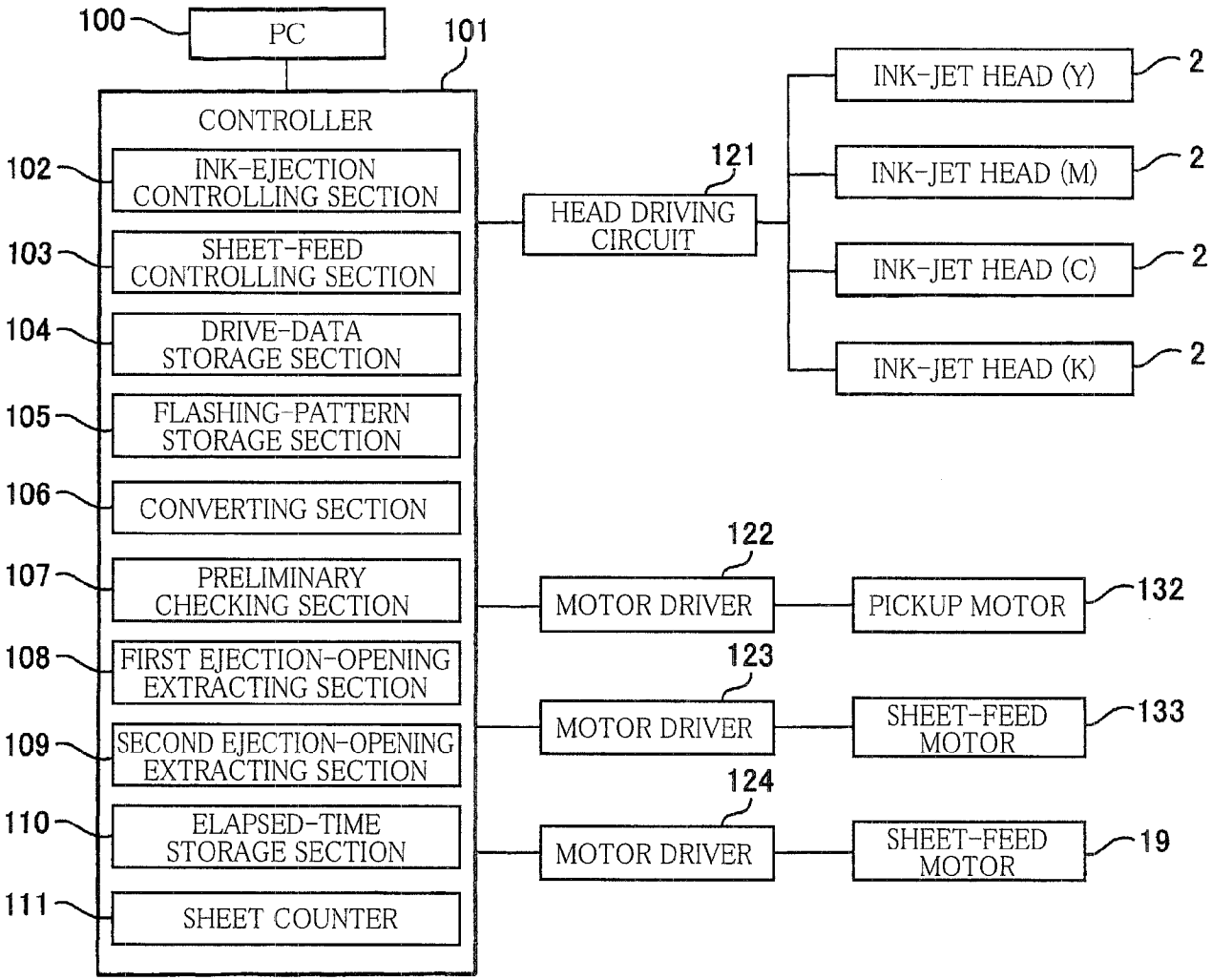
FIG. 2 is a block diagram of the ink-jet printer shown in FIG. 1.

As shown in FIG. 1, an ink-jet printer 1 which is an image recording apparatus as a first embodiment of the present invention includes a casing 1*a* having a rectangular parallelepiped shape. In the casing 1*a*, there are disposed (a) four ink-jet heads 2 which respectively eject inks of four colors, namely, magenta, cyan, yellow, and black, and (b) a sheet-feed unit 16. A sheet-supply tray 11 attachable to and detachable from the casing 1*a* is disposed below the sheet-feed unit 16. An ink tank unit 1*b* attachable to and detachable from the casing 1*a* is disposed below the sheet-supply tray 11. A controller 101 which controls operations of the printer 1 is mounted on an inner surface of a top plate of the casing 1*a*. An upper surface of the top plate functions as a sheet-discharge portion 15 onto which a recorded sheet P which has already been recorded is discharged and placed. As shown in FIG. 2, the controller 101 is connected to a personal computer (a PC) 100. Each of the ink jet heads 2 is driven by a head driving circuit 121.

A sheet-feed path through which the sheet P is fed is formed in the ink-jet printer 1 from the sheet-supply tray 11 toward the sheet-discharge portion 15 along bold arrow shown in FIG. 1. The sheet-supply tray 11 has a box-like shape opening upward so as to accommodate a plurality of sheets P in a state in which the sheets P are stacked on each other. An uppermost one of the sheets P accommodated in the sheet-supply tray 11 is supplied or picked up by a pickup roller 12. The supplied sheet P is fed to the sheet-feed unit 16 by a pair of rollers 14 while being guided by guides 13*a*, 13*b*. The pickup roller 12 is rotated by a pickup motor 132. The pickup motor 132 is driven by a motor driver 122.

The sheet-feed unit 16 includes two belt rollers 6, 7, a sheet-feed belt 8, a tension roller 10, and a platen 18. The sheet-feed belt 8 is an endless belt which is wound around the belt rollers 6, 7 so as to bridge the rollers 6, 7. The tension roller 10 applies tension to the sheet-feed belt 8 by biasing or forcing the sheet-feed belt 8 downward from an inner surface of the belt 8. The platen 18 is disposed in an area surrounded by the sheet-feed belt 8 and supports the sheet-feed belt 8 at a position facing the heads 2 such that the sheet-feed belt 8 is not bent or warped downward. The belt roller 7 is a drive roller rotated in a clockwise direction in FIG. 1 with a drive force applied to a shaft of the belt roller 7 from a sheet-feed motor 19. The sheet-feed motor 19 is driven by a motor driver 124. The belt roller 6 is a driven roller rotated in the clockwise direction in FIG. 1 with rotation of the sheet-feed belt 8 by rotation of the belt roller 7. It is noted that the drive force of the sheet-feed motor 19 is transmitted to the belt roller 7 via a plurality of gears.

An outer peripheral surface 8*a* of the sheet-feed belt 8 has a viscosity by being subjected to a silicone treatment. A nip roller 4 is disposed at a position facing to the belt roller 6. The nip roller 4 presses each sheet P supplied and fed from the sheet-supply tray 11 onto the outer peripheral surface 8*a* of the sheet-feed belt 8. The sheet P pressed onto the outer peripheral surface 8*a* is fed in a sheet-feed direction (which is a rightward direction in FIG. 1 and a sub-scanning direction) while being held by and on the outer peripheral surface 8*a* owing to the viscosity thereof. In the present embodiment, the sheet-feed unit 16 functions as a moving mechanism which moves the sheet P relative to the heads 2 in the sheet-feed direction.

A peeling plate 5 is provided at a position facing to the belt roller 7. The peeling plate 5 peels the sheet P from the outer peripheral surface 8*a*. The peeled sheet P is fed by two pairs of rollers 28 while being guided by guides 29*a*, 29*b*. Then, the sheet P is discharged onto the sheet-discharge portion 15 from a sheet-discharge opening 30 formed in an upper portion of the casing 1*a*. One of each pair of the three pairs of rollers 14, 28 is a drive roller which is rotated by a drive force of a sheet-feed motor 133 controlled by the controller 101. The other of each pair of rollers 14, 28 is a driven roller which is rotated with the rotation of a corresponding one of the rollers. The sheet-feed motor 133 is driven by a motor driver 123.

The four heads 2 respectively eject the inks of four colors different from each other, namely, magenta, yellow, cyan, and black. Each of the four heads 2 has a generally rectangular parallelepiped shape elongated in a main scanning direction (a first direction). Further, the four heads 2 are fixed so as to be arranged in the sheet-feed direction in which the sheet P is fed. That is, this printer 1 is a printer of line type.

A bottom surface of each head 2 functions as an ink-ejection surface 2*a*. In the ink-ejection surface 2*a* are formed a plurality of ink-ejection openings through which the ink is ejected. The plurality of ink-ejection openings are formed in each ink-ejection surface 2*a* in a direction parallel to the ink-ejection surface 2*a* and vertical to the sheet-feed direction, that is, in the main scanning direction (i.e., a longitudinal direction of the heads 2) so as to achieve a first resolution (i.e., a predetermined resolution). That is, the plurality of ink-ejection openings are formed in the ink-ejection surface 2*a* at predetermined intervals in the main scanning direction such that the image to be recorded on the sheet P has the first resolution. In the present embodiment, the plurality of ink-ejection openings are arranged in matrix in the ink-ejection surface 2*a*. When the fed sheet P is passed through just below the four heads 2, the inks of the respective four colors are ejected in order onto an upper surface of the sheet P from the ink-ejection openings. As a result, a desired color image is formed on the upper surface (i.e., a recording surface) of the sheet P.

Each of the heads 2 is connected to a corresponding one of ink tanks 17 in the ink tank unit 1*b*. The four ink tanks 17 respectively store the inks of the respective four colors. The inks are respectively supplied from the ink tanks 17 to the heads 2 through tubes.

[Configuration of Controller]

There will be explained the controller 101 in detail. The controller 101 includes a Central Processing Unit (CPU), an Electrically Erasable and Programmable Read Only Memory (EEPROM) which is a rewritable memory storing programs performed by the CPU and data used for the programs, and a Random Access Memory (RAM) temporarily storing data during the performance of the programs. The controller 101 functions, by cooperation of these hardware and software in EEPROM, as an ink-ejection controlling section 102, a sheet-feed controlling section 103, a drive-data storage portion 104, a flashing-pattern storage section 105, a converting section 106, a preliminary checking section 107, a first ejection-opening extracting section 108, a second ejection-opening extracting section 109, an elapsed-time storage section 110, a sheet counter 111, and so on.

The drive-data storage portion 104 stores drive data of the heads 2 which is about the image to be formed on the sheet P and which is transmitted from the PC 100. In the present embodiment, the drive data represents an amount of the ink (i.e., an ink amount) to be ejected on each recording cycle from each of the ink-ejection openings arranged in the main scanning direction in correspondence with the image to be recorded on the sheet P. Further, the drive data represents a position of each image dot formed on the sheet P in a virtual sheet P' by which the sheet P is represented in a data space. Here, the recording cycle is defined as a length of time required for the movement of the sheet P relative to the heads 2 by a unit distance which corresponds to a recording resolution (a second resolution) in the sheet-feed direction (i.e., the sub-scanning direction or a second direction). The ink amount by which the ink is ejected from each ink-ejection opening during one recording cycle may include zero, a small amount, a moderate amount, and a large amount, for example. Further, for a preliminary ejection, the ink amount may additionally include a very small amount which is smaller than the small amount in the ink amount. It is noted that the preliminary ejection is ink-ejection for forming dots not forming the image on the sheet P. That is, the preliminary ejection is ink-ejection not based on original drive data. The number of the preliminary ejections is determined so as not to deteriorate the performance of the ink ejection to an extent more than a predetermined level. This number is determined by, e.g., an ink property, a shape of ink channels, and environmental conditions. The preliminary ejection may be performed on a plurality of the sheets P.

The ink-ejection controlling section 102 controls the head driving circuit 121 on the basis of the drive data stored in the drive-data storage portion 104 such that the ink is ejected from each of the ink-jet heads 2 at desired timings. Further, as will be described below, the ink-ejection controlling section 102 controls the head driving circuit 121 such that the preliminary ejection is performed when predetermined conditions are satisfied.

Here, there will be explained a virtual construction in which the number of the ink-ejection openings of each head 2 is thirty-nine. The sheet P shown in FIG. 3A can be divided into 1248 areas of 39×32 respectively in the main scanning direction and in the sub-scanning direction in a lattice shape. In this case, the virtual sheet P' is also expressed by a virtual area constituted by 1248 pixels of 39×32 arranged in matrix. Each of the areas has a length corresponding to the first resolution in the main scanning direction and a distance corresponding to the second resolution in the sub-scanning direction. The image recorded on the sheet P is expressed by selection of one or ones of the 1248 areas onto which the inks are attached. Onto thirty-two areas constituting each of area rows in the sub-scanning direction, only ink droplets ejected from a corresponding one of the ink-ejection openings of the head 2 can be attached.

Figure 3A:
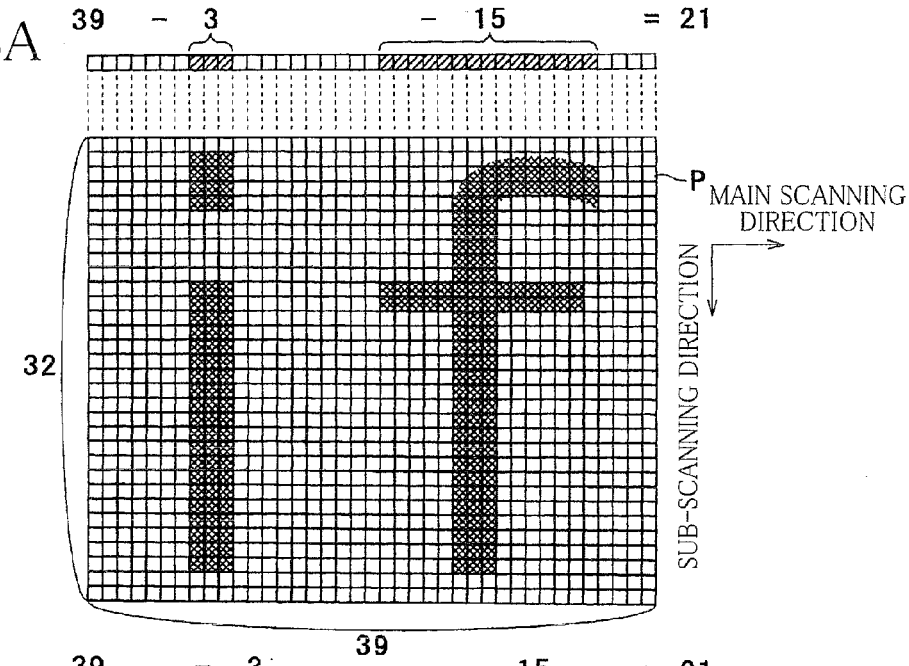
FIGS. 3A, 3B, 3C, and 3D are schematic views each for explaining an example of an image recorded on a sheet in the case where the image is shifted.

FIG. 3A shows a state in which a word "if" is recorded on the sheet P. A character "i" is a set of a plurality of dots formed on the sheet P by attachment of the ink droplets ejected from three of the ink-ejection openings onto a plurality of the areas. Likewise, a character "f" is a set of a plurality of dots formed on the sheet P by the attachment of the ink droplets ejected onto a plurality of the areas from consecutive fifteen of the ink-ejection openings which are different from the three ink-ejection openings forming the character "i". Thus, when the word "if" is recorded on the sheet P, no ink droplets are ejected from twenty-one (39−3−15=21) of the ink-ejection openings.

The sheet-feed controlling section 103 controls the motor drivers 122-124 such that the sheet P is fed through the sheet-feed path and discharged onto the sheet-discharge portion 15 at a desired timing.

The flashing-pattern storage section 105 stores a flashing pattern in which one of the pixels in each of pixel rows extending in the sub-scanning direction is a preliminary-ejection candidate pixel in virtual matrix in which predetermined numbers of pixels (virtual pixels) are arranged respectively in the main scanning direction and the sub-scanning direction in the lattice shape. In this virtual matrix, there are arranged, in the main scanning direction, the same number of the pixels as the ink-ejection openings of each head 2, and there are arranged, in the sub-scanning direction, the same number of the pixels as a value obtained by dividing a specific length by a distance corresponding to the second resolution. The specific length is a length, in the sub-scanning direction, of a specific area (hereinafter may be referred to as a "preliminary ejection area") in which preliminary ejection dots are formed on the sheet P, and the largest length of the specific length is the same as a length of the sheet P in the sub-scanning direction. The preliminary-ejection candidate pixel is a pixel corresponding to each area in which the preliminary ejection dot can be formed in the preliminary ejection area.

Figure 3B:
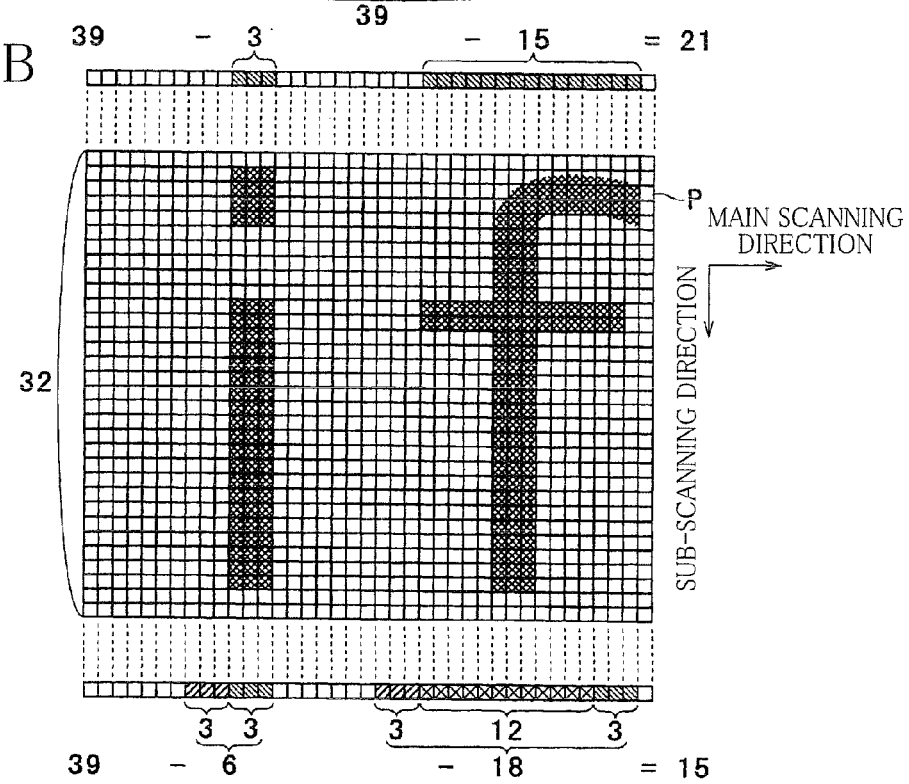
Figure 3C:
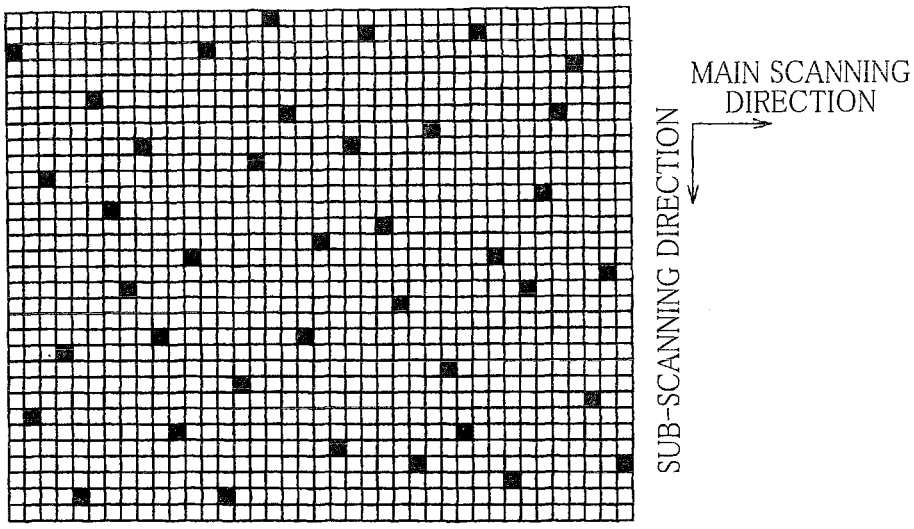

Here, there will be explained a virtual construction in which the number of the ink-ejection openings of each head 2 is thirty-nine. FIG. 3C shows a flashing pattern in which the same number (thirty-nine) of the preliminary-ejection candidate pixels (each shown in a black-colored box) as the pixel row extending in the sub-scanning direction in the virtual matrix in which 1248 pixels are arranged in the lattice shape such that thirty-nine pixels are arranged in the main scanning direction while thirty-two pixels are arranged in the sub-scanning direction. A shape in which the preliminary ejection dots are disposed on the sheet P is determined on the basis of the flashing pattern. In an example in FIG. 3C, each of the thirty-nine preliminary-ejection candidate pixels is disposed at a corresponding one of the pixel rows in the sub-scanning direction, and partly constitutes the flashing pattern. It is noted that, in this explanation, a recording area in which the image is recorded on the sheet P and the preliminary ejection area coincide or overlap with each other, and each of the areas has a length of 39×(the distance corresponding to the first resolution) in the main scanning direction and a length of 32×(the distance corresponding to the second resolution) in the sub-scanning direction.

The converting section 106 converts the drive data stored in the drive-data storage portion 104. Specifically, the converting section 106 converts the drive data such that an image position adjustment which is a shift of the image in the sheet P in the main scanning direction in units of the distance corresponding to the first resolution is performed for the image to be recorded on the sheet P. The drive data converted by the converting section 106 is stored into the drive-data storage portion 104 as converted drive data. The converting section 106 converts the drive data stored in the drive-data storage portion 104 not when the recording is performed for each of all the sheets P but only when conditions which will be described in detail are satisfied. FIG. 3B shows as an example a state in which the word "if" shown in FIG. 3A is shifted rightward by three dots. Other functions of the converting section 106 will be described later.

In the present embodiment, an amount of the shift (hereinafter may be referred to as a "shift amount") in the conversion of the converting section 106 is not fixed in advance. The preliminary checking section 107 has functions the same as those of the above-described converting section 106, and the first ejection-opening extracting section 108 and the second ejection-opening extracting section 109 which will be described below for determination of the shift amount by the converting section 106. The preliminary checking section 107 preliminarily checks the presence or absence of the ejection (or the number of the ejections) of the ink droplet from each ink-ejection opening, for each of a plurality of the shifts whose shift amounts in the main scanning direction are different from each other. In the present embodiment, the preliminary checking section 107 shifts as a trial the image in the main scanning direction by −3, −2, −1, 0, +1, +2, and +3 dots (signs "−" and "+" respectively represent a leftward shift and a rightward shift), and preliminarily checks the presence or absence of the ejection of the ink droplet from each ink-ejection opening for each of the shift values. The preliminary check of the preliminary checking section 107 is preferably performed equally in the rightward and leftward directions by the same pixel(s). Specifically, the preliminary checking section 107 detects a position(s) and the number of the ink-ejection opening(s) which has or have not been used in the latest or previous recording on a previous sheet P and stores the position and the number. Then, the preliminary checking section 107 detects a position(s) and the number of the ink-ejection opening(s) which is or are not to be used in the next recording. In this time, the preliminary checking section 107 detects in order a position(s) and the number of the ink-ejection opening(s) in this recording which is or are not used in each shift amount while temporarily rewriting the drive data and, the preliminary checking section 107 compares the respective positions of the ink-ejection openings in the latest recording and the respective positions of the ink-ejection openings in each shift amount to the position(s) of the ink-ejection opening(s) in this recording which is or are not used in each shift amount. The preliminary checking section 107 calculates the number of the ink-ejection openings located at the position(s) at which the ink-ejection openings in the latest recording and in each shift amount coincide with each other in this comparison, and stores a relationship between the number of coinciding position(s) and the shift amount in which the positions coincide with each other. This relationship reflects on a processing of the converting section 106. As thus described, the preliminary checking section 107 detects only the position(s) of the ink-ejection openings and the presence or absence of the ejection from the ink-ejection openings.

The first ejection-opening extracting section 108 extracts the ink-ejection opening(s) whose number of the ejection of the ink droplet is smaller than a second predetermined number (one in this embodiment) among the ink-ejection openings of each head 2, during the recording of the image on the sheet(s) P of a first predetermined number (one in this embodiment) on the basis of the drive data which has not been converted by the converting section 106. For example, where the word "if" shown in FIG. 3A which has not been shifted is recorded on the sheet P, in the present embodiment, the first ejection-opening extracting section 108 extracts twenty-one ink-ejection openings from which the ink is not ejected, that is, the first ejection-opening extracting section 108 extracts white-colored boxes of thirty-nine boxes located on an upper portion of FIG. 3A.

On the other hand, the second ejection-opening extracting section 109 extracts the ink-ejection opening(s) whose number of the ejection of the ink droplet is smaller than a fourth predetermined number (one in this embodiment) among the ink-ejection openings of each head 2, during the recording of the image on the sheet(s) P of a third predetermined number (one in this embodiment) on the basis of the converted drive data which has been converted by the converting section 106. For example, where the word "if" shown in FIG. 3B which has shifted by +3 dots is recorded on the sheet P, in the present embodiment, the second ejection-opening extracting section 109 extracts twenty-one ink-ejection openings from which the ink is not ejected, that is, the second ejection-opening extracting section 109 extracts white-colored boxes of thirty-nine boxes located on an upper portion of FIG. 3B.

The converting section 106 determines the shift amount in which the number of the ink-ejection openings extracted twice (hereinafter may be referred to as the "overlapping extracted openings number") is the smallest among the seven different shifts, on the basis of a result of the preliminary check for the seven different shifts performed by the preliminary checking section 107. Further, the converting section 106 converts the drive data stored in the drive-data storage portion 104 such that the image position adjustment is performed using the determined shift amount.

There will be explained these operations on the basis of an example of FIG. 3A. As shown in FIG. 3B, where the image is shifted by +3 dots, the overlapping extracted openings number is fifteen. Although not explained in detail, the overlapping extracted openings number is seventeen in the case of +2 dots, nineteen in the case of +1 dot, twenty-one in the case of 0 dot, nineteen in the case of −1 dot, seventeen in the case of −2 dots, and fifteen in the case of −3 dots. In this case, the converting section 106 converts the drive data stored in the drive-data storage portion 104 such that the image position adjustment is performed with the shift of the image by +3 dots or −3 dots in each of which the overlapping extracted openings number is the smallest. That is, in this case, either of +3 dots and −3 dots may be selected. As a modification, this ink-jet printer 1 may be configured such that one of +3 dots and −3 dots which is larger than the other in the shortest distance from one of the dots constituting the image to an edge of the sheet P is selected in this case. It is noted that, in FIGS. 3A and 3B, the word "if" shown in FIG. 3A is used as an example of the image to be recorded on the sheet P on the basis of the drive data which has not been converted by the converting section 106, while the word "if" shown in FIG. 3B is used as an example of the image to be recorded on the sheet P on the basis of the drive data which has been converted by the converting section 106, but a pattern of the image to be recorded on the basis of the drive data which is not converted and a pattern of the image to be recorded on the basis of the drive data which is converted do not need to be the same as each other, and may be different from each other. In this case, for example, this ink-jet printer 1 may be configured such that the drive data corresponding to one of the different images which is recorded on the sheet P first is set as the drive data which is not been converted, and the drive data corresponding to the other of the different images which is subsequently recorded on the sheet P is set as the drive data which is converted. In this case, it is possible to obtain the overlapping extracted openings number of the ejection openings extracted by the first ejection-opening extracting section 108 and the second ejection-opening extracting section 109 for each drive data and to determine the shift amount.

It is noted that, in the present embodiment, the preliminary checking section 107 preliminarily checks the overlapping extracted openings number in order of the shift amounts of −3, −2, −1, 0, +1, +2, and +3, and stores and overwrites, when the overlapping extracted openings number becomes the smallest, the shift amount in this time into a memory in the controller 101. Thus, the converting section 106 converts the drive data stored in the drive-data storage portion 104 such that the image position adjustment is performed with the shift of the image by +3 dots. Where the above-described order of the check of the shift amount is reversed in the preliminary check, the image position adjustment is performed with the shift of the image by −3 dots.

In the example of FIG. 3A, absolute values of the respective two shift amounts in each of which the overlapping extracted openings number becomes the smallest are the same as each other. However, where there are a plurality of the image position adjustments whose shift amounts are different from each other and in each of which the overlapping extracted openings number becomes the smallest, the converting section 106 converts the drive data stored in the drive-data storage portion 104 such that the image position adjustment is performed with the shift in which the absolute value of the shift amount becomes the smallest among these image position adjustments.

The elapsed-time storage section 110 stores a length of time elapsed from a time at which the latest image recording performed by the printer 1 is finished. The elapsed time stored in the elapsed-time storage section 110 is initialized each time when the recording is finished.

The sheet counter 111 has an initial value set to one and increments the value by one each time when the recording on each sheet P is finished. A storage content of the sheet counter 111 is initialized to one when a recovering processing is performed in S3 shown in FIG. 4. That is, a count value of the sheet counter 111 represents the number obtained by adding the number of the recorded sheets P from the latest recovering processing by one.

The ink-ejection controlling section 102 controls the ink ejection from each head 2 such that the ink droplets are ejected from each head 2 on the basis of the drive data which has not been converted by the converting section 106, in the case where the elapsed time stored in the elapsed-time storage section 110 is equal to or longer than a predetermined length of time, and in the case where the elapsed time is shorter than the predetermined length of time, and the count value of the sheet counter 111 is an odd number. As a result, the image is normally recorded on the sheet P without the shift.

Further, the ink-ejection controlling section 102 controls the ink ejection from each head 2 such that the ink droplets are ejected from each head 2 on the basis of the drive data which has been converted by the converting section 106, in the case where the elapsed time is shorter than the predetermined length of time, and the count value of the sheet counter 111 is an even number. As a result, the image shifted in the main scanning direction by the shift amount determined by the converting section 106 is recorded on the sheet P. It is noted that the same drive data may be used for the plurality of the sheets P in the image recording, and different drive data may be used in order.

Further, in the case where the elapsed time is shorter than the predetermined length of time, and the count value of the sheet counter 111 is the even number, the ink-ejection controlling section 102 controls the ink ejection from each head 2 such that the preliminary ejection from the ink-ejection opening(s) (which has or have been extracted twice in the image recording on two sheets P whose count values are successive in order of the odd number and the even number) extracted by the first ejection-opening extracting section 108 in the latest image recording on the sheet P and extracted by the second ejection-opening extracting section 109 in the image recording on the sheet P is performed once on the sheet P of the even number. As a result, the preliminary ejection dots are formed on the sheet P of the even number in addition to the shifted image. The ink amount in the preliminary ejection from each ink-ejection opening during one recording cycle is not particularly limited, and may be the same as the above-described small amount of the four types, for example. Here, the preliminary ejection dots are formed by the ink droplets each having the very small amount for the preliminary ejection. Thus, a viewability or a visibility of the preliminary ejection dots is extremely small.

A timing in which the preliminary ejection is performed for the ink-ejection opening(s) extracted twice is determined by the flashing pattern stored in the flashing-pattern storage section 105. There will be explained this operation in the above-described explanation. Where the converting section 106 has converted the drive data such that the image position adjustment is performed with the shift of the image by +3 dots in which the overlapping extracted openings number is the smallest (fifteen), the ink-ejection controlling section 102 specifies fifteen (39−6−18) white-colored boxes of thirty-nine boxes located on a lower portion of FIG. 3B. It is noted that each white-colored box represents the ink-ejection opening extracted twice.

Figure 3D:
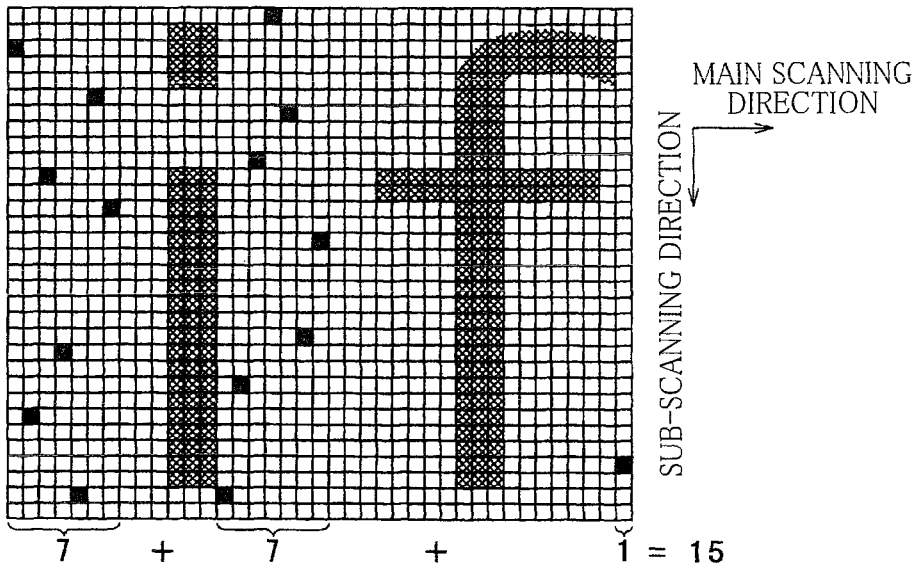

Further, the ink-ejection controlling section 102 superposes (a) fifteen pixel rows respectively corresponding to the specified fifteen white-colored boxes in the flashing pattern stored in the flashing-pattern storage section 105 and (b) the converted drive data converted by the converting section 106. As a result, an ink-ejection pattern shown in FIG. 3D is produced. The ink-ejection pattern shown in FIG. 3D includes the word "if" shifted by +3 dots. In the ink-ejection pattern, each of the fifteen pixel rows respectively corresponding to the specified fifteen white-colored boxes includes one preliminary ejection pixel. Each preliminary ejection pixel is located at the same position as the preliminary-ejection candidate pixel of a corresponding one of the pixel rows in the flashing pattern shown in FIG. 3C. The ink-ejection controlling section 102 controls the ink ejection of each head 2 on the basis of modified drive data obtained by this superposing operation. As a result, as shown in FIG. 3D, the word or the image "if" shifted by +3 dots and fifteen (7+7+1) preliminary ejection dots are recorded on the sheet P of the even number.

If the above-described shift of the image is not performed, the number of the ink-ejection openings for which the preliminary ejection is to be performed is twenty-one. This results in a larger amount of the ink consumed in the preliminary ejection. However, in the present embodiment, the control of the shift of the image is performed, thereby reducing the number of the ink-ejection openings for which the preliminary ejection is to be performed to fifteen. This makes it possible to reduce the amount of the ink consumed in the preliminary ejection. Further, ink-ejection failure is not caused because of the reduction in the number of the ink-ejection openings for which the preliminary ejection is to be performed. As thus described, according to the present embodiment, it is possible to achieve both of the reduction of the ink amount in the preliminary ejection and restraint of the ink-ejection failure.

[Image Recording Operation]

Figure 4:
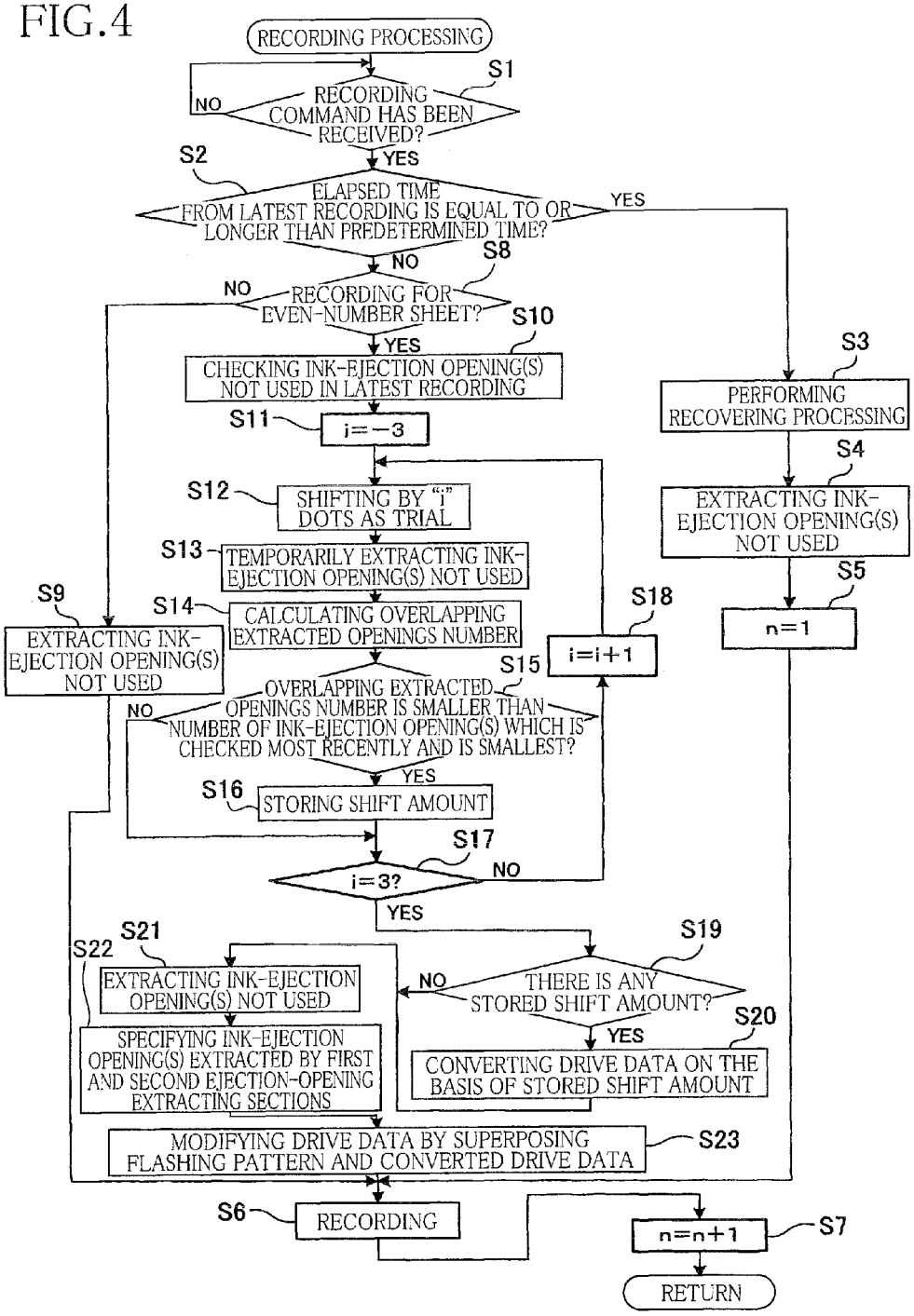
FIG. 4 is a flow-chart showing a recording processing performed by the ink-jet printer shown in FIG. 1 in the case where the image is shifted.

There will be next explained, with reference to a flow-chart in FIG. 4, a recording processing in which operations relating to the image recording are performed by the printer 1 as the present embodiment.

Initially, in S1, the controller 101 of the printer 1 repeatedly judges whether the controller 101 has received a recording command from the PC 100 or not and/or whether there is any sheet not subjected to the recording on the basis of a recording command received before or not. Here, there are cases where the recording command is transmitted with the drive data or image data before converted to the drive data (e.g., image data produced in a general format such as JPEG) and where the recording command is transmitted without the drive data or the image data. Where the recording command is transmitted without the drive data or the image data, the drive data stored in the drive-data storage portion 104 which has been already transmitted to the printer 1 is designated as a recording object. It is noted that the image data received from the PC 100 is stored into the drive-data storage portion 104 after converted to the drive data by the controller 101. Further, when the printer 1 has received the recording command, the sheet-feed controlling section 103 starts the feeding of the sheet P at an appropriate timing.

In S2, the controller 101 judges whether the elapsed time stored in the elapsed-time storage section 110 is equal to or longer than the predetermined length of time or not. As described above, the elapsed time stored in the elapsed-time storage section 110 represents the length of time elapsed from the time at which the latest image recording performed by the printer 1 is finished.

Where the controller 101 has judged that the elapsed time is equal to or longer than the predetermined length of time (S2: YES), this recording processing goes to S3. In S3, the controller 101 performs the recovering processing of the heads 2. In the present embodiment, the recovering processing includes both of a purging operation in which the ink of each head 2 is forced to be ejected using a pump, not shown, and a wiping operation in which the ink-ejection surfaces 2*a* are wiped by a wiper, not shown, after the purging operation.

In S4, the first ejection-opening extracting section 108 extracts the ink-ejection opening(s) each of which is not used for the ejection of the ink droplet in the next image recording to be performed on one sheet P, on the basis of the drive data stored in the drive-data storage portion 104 which has not been converted by the converting section 106. A result of the extraction is stored into the memory in the controller 101.

Then, in S5, the count value of the sheet counter 111 is initialized to one. Then, in S6, the ink-ejection controlling section 102 controls the ejection of the ink droplets from each head 2 on the basis of the drive data stored in the drive-data storage portion 104. As a result, an image exactly based on the image data having not been converted by the converting section 106 is recorded on the sheet P. Specifically, the image "if" not shifted shown in FIG. 3A is recorded on the sheet P. Then, in S7, the count value of the sheet counter 111 is incremented by one, and this recording processing returns to S1.

Where the controller 101 has judged that the elapsed time is shorter than the predetermined length of time (S2: NO), this recording processing goes to S8. In S8, the controller 101 judges whether the current count value of the sheet counter 111 is the even number or the odd number. Here, the current count value of the sheet counter 111 represents that the next recording to be performed on one sheet P is for the even-number sheet or the odd-number sheet as counted from the latest recovering processing performed in S3. Where the controller 101 has judged that the current count value of the sheet counter 111 is the odd number (S8: NO), this recording processing goes to S9.

In S9, like in S4, the first ejection-opening extracting section 108 extracts the ink-ejection opening(s) each of which is not used for the ejection of the ink droplet in the next image recording to be performed on one sheet P, on the basis of the drive data stored in the drive-data storage portion 104 which has not been converted by the converting section 106. Then, in S6, the image recording is performed on one sheet P, then, in S7, the count value of the sheet counter 111 is incremented by one, and this recording processing returns to S1.

Where the controller 101 has judged that the current count value of the sheet counter 111 is the even number (S8: YES), this recording processing goes to S10. In S10, the controller 101 checks, on the basis of the extractions in S4 or S9, the ink-ejection opening(s) from each of which no ink droplets have been ejected in the latest image recording on one sheet P. Specifically, the controller 101 loads data about the ink-ejection opening(s) extracted in S4 or S9.

Then, in S11, the controller 101 initializes a parameter "i" about the shift amount to −3. Then, in S12, the preliminary checking section 107 shifts, as a trial, the image by "i" dots. Specifically, like the operation of the converting section 106, the preliminary checking section 107 converts the drive data stored in the drive-data storage portion 104 such that the image is shifted by the "i" dots. Further, in S13, the preliminary checking section 107 temporarily extracts the ink-ejection opening(s) not to be used for the ejection of the ink droplets in the recording on the sheet P shifted as a trial in S12. This temporary extraction is the same as the operation performed by the second ejection-opening extracting section 109. Then, in S14, the preliminary checking section 107 calculates the number of the ink-ejection opening(s) which is or are the ink-ejection opening(s) checked in S10 and which is or are the ink-ejection opening(s) temporarily extracted in S13 (i.e., the overlapping extracted openings number).

In S15, the preliminary checking section 107 judges whether or not the number of the ink-ejection openings which has been calculated in S14 is smaller than the number of the ink-ejection opening(s) which has or have been checked in S10 in the latest recording and is the smallest among the number(s) of the ink-ejection openings which has or have been calculated in the processing(s) of S14 performed in the past. Then, where these conditions are satisfied (S15: YES), this recording processing goes to S16. In S16, the controller 101 stores all the shift amount(s) in which the conditions are satisfied into the memory in the controller 101, and this recording processing goes to S17. In this time, where the controller 101 has found the overlapping extracted openings number which is smaller than the overlapping extracted openings number having been judged to be the smallest, the shift amount corresponding to this newly found overlapping extracted openings number is overwritten and stored. Further, as long as the above-described conditions are satisfied, a plurality of the shift amounts whose overlapping extracted openings numbers are the same as each other are all stored. On the other hand, where the above-described conditions are not satisfied (S15: NO), this recording processing skips S16 and goes to S17.

In S17, the preliminary checking section 107 judges whether a current value of the parameter "i" is three or not. Where the preliminary checking section 107 has judged that the current value of the parameter "i" is smaller than three (S17: NO), the parameter "i" is incremented by one in S18, and this recording processing returns to S12 from which the same processings are repeated. Where the current value of the parameter "i" is three (S17: YES), this recording processing goes to S19.

In S19, the converting section 106 judges whether any shift amount is stored in the memory in the controller 101 or not. In the example with reference to FIGS. 3A-3D, "+3" is stored as the shift amount, and thus the converting section 106 judges that the shift amount is stored. Where the converting section 106 has judged that the shift amount is not stored (S19: NO), the converting section 106 judges that the image position adjustment is unnecessary, and the drive data is not converted. Then, this recording processing goes to S21. In S21, the second ejection-opening extracting section 109 extracts the ink-ejection opening(s) not to be used for the ejection of the ink droplets in the next image recording to be performed on one sheet P. This extraction is performed on the basis of the drive data which has not been converted. Then, in S22, the ink-ejection controlling section 102 specifies the ink-ejection opening(s) extracted by the first ejection-opening extracting section 108 and also extracted by the second ejection-opening extracting section 109. Then, this recording processing goes to S23, S6, and S7, but these processings performed by the ink-ejection controlling section 102 are the same as in the case where the shift amount(s) is or are stored in the controller 101, which will be described below. As a result of the processings of S23, S6, and S7, the image "if" having not been shifted is recorded on the sheet P in addition to the preliminary ejection dots. Then, in S7, the count value of the sheet counter 111 is incremented by one, and this recording processing returns to S1.

On the other hand, where the converting section 106 has judged that the shift amount(s) is or are stored (S19: YES), this recording processing goes to S20. In S20, the converting section 106 converts the drive data stored in the drive-data storage portion 104 such that the image position adjustment is performed on the basis of the shift amount(s). In this time, where the plurality of the shift amounts are stored in the memory, the converting section 106 converts the drive data stored in the drive-data storage portion 104 such that the image position adjustment is performed with the shift of the image by the shift amount whose absolute value is the smallest among the plurality of the shift amounts. It is noted that the conversion of the drive data by the converting section 106 is performed such that the amount of the ink droplets to be ejected from each of the ink-ejection openings formed in the ink-ejection surface 2*a* of each head 2 is adjusted in correspondence with the shift amount in the main scanning direction in order to perform the image position adjustment based on the shift amount stored in the memory of the controller 101. More specifically, the conversion of the drive data is performed such that the amount of the ink droplets ejected from each ink-ejection opening on the basis of the drive data having not been converted becomes on each recording cycle the amount of the ink-droplets ejected from each ink-ejection opening of the ink-ejection surface 2*a* which is located at a position shifted by the shift amount in the main scanning direction. Thus, in the case where the shift amount is +3 dots, the drive data is converted such that the amount of the ink ejected from each ink-ejection opening on the basis of the drive data having not been converted becomes the amount of the ink ejected from each ink-ejection opening whose position has been shifted by +3 dots.

Then, in S21, the second ejection-opening extracting section 109 extracts the ink-ejection opening(s) not to be used for the ejection of the ink droplets in the next image recording to be performed on one sheet P, on the basis of the converted drive data having been converted by the converting section 106 in S20. Further, in S22, the ink-ejection controlling section 102 specifies the ink-ejection opening(s) which is or are the ink-ejection opening(s) extracted in S4 or S9 by the first ejection-opening extracting section 108 in the latest image recording on one sheet P and which is or are also the ink-ejection opening(s) extracted in S21 by the second ejection-opening extracting section 109 in the next image recording on one sheet P. It is noted that the specified ink-ejection opening may be hereinafter referred to as an "overlapping extracted ink-ejection opening". Identification data of the specified overlapping extracted ink-ejection opening(s) is written into the memory in the controller 101.

In S23, the ink-ejection controlling section 102 modifies the drive data converted by the converting section 106 in S20. Specifically, the ink-ejection controlling section 102 superposes (a) the pixel row(s) each including the overlapping extracted ink-ejection opening(s) specified in S22 in the flashing pattern stored in the flashing-pattern storage section 105 and (b) the converted drive data converted by the converting section 106 in S20. As a result, as described above, the ink-ejection pattern shown in FIG. 3D is produced. Then, in S6, the image recording is performed on one sheet P on the basis of the modified drive data modified in S23, then, in S7, the count value of the sheet counter 111 is incremented by one, and this recording processing returns to S1.

According to the present embodiment, the ink-jet printer 1 not only performs the ink ejection on the basis of the drive data not subjected to the shift adjustment by the converting section 106, but also performs the ink ejection on the basis of the drive data subjected to the shift adjustment by the converting section 106, thereby reducing the number of the ink-ejection openings in each of which the preliminary ejection needs to be performed. As a result, the amount of the ink required for the preliminary ejection can be reduced while restraining the ink-ejection failure by performing the preliminary ejection.

Further, in the present embodiment, the converting section 106 converts the drive data on the basis of the result of the preliminary check performed by the preliminary checking section 107 such that the image position adjustment is performed with the shift of the image by the shift amount in which the overlapping extracted openings number is the smallest. As a result, it is possible to increase a possibility that the amount of the ink required for the preliminary ejection can be further reduced.

Further, in the present embodiment, where there are a plurality of the image position adjustments whose shift amounts are different from each other and in each of which the overlapping extracted openings number is the smallest, the converting section 106 converts the drive data with the shift amount having the smallest absolute value among these plurality of image position adjustments. Thus, it is possible to restrain an amount of a displacement between a position of the image in the sheet P based on the drive data having not been converted and a position of the image in the sheet P based on the drive data having been converted as small as possible.

Further, in the present embodiment, since the preliminary ejection is performed only where the length of time elapsed from the time at which the latest image recording performed on the sheet P is shorter than the predetermined length of time, it is possible to prevent unnecessary preliminary ejection to be performed at the time when the elapsed time becomes long to such an extent that the ink-ejection failure cannot be recovered by the preliminary ejection.

Second Embodiment

There will be next explained a second embodiment of the present invention. In the present embodiment, the shift of the image in the main scanning direction in the first embodiment is replaced with 180-degree rotation. An overall construction of a printer in the present embodiment is the same as that in the above-described first embodiment. Thus, in the explanation of the present embodiment, the same reference numerals used in the first embodiment may be used for elements included in the printer in the present embodiment. Further, like in the first embodiment, the controller 101 functions as the ink-ejection controlling section 102, the sheet-feed controlling section 103, the drive-data storage portion 104, the flashing-pattern storage section 105, the converting section 106, the preliminary checking section 107, the first ejection-opening extracting section 108, the second ejection-opening extracting section 109, the elapsed-time storage section 110, the sheet counter 111, and so on. The flashing-pattern storage section 105 stores the flashing pattern the same as that shown in FIG. 3C. Each of the ink-ejection controlling section 102, the sheet-feed controlling section 103, the drive-data storage portion 104, the first ejection-opening extracting section 108, the second ejection-opening extracting section 109, the elapsed-time storage section 110, and the sheet counter 111 has functions the same as those in the first embodiment.

Figure 5A:
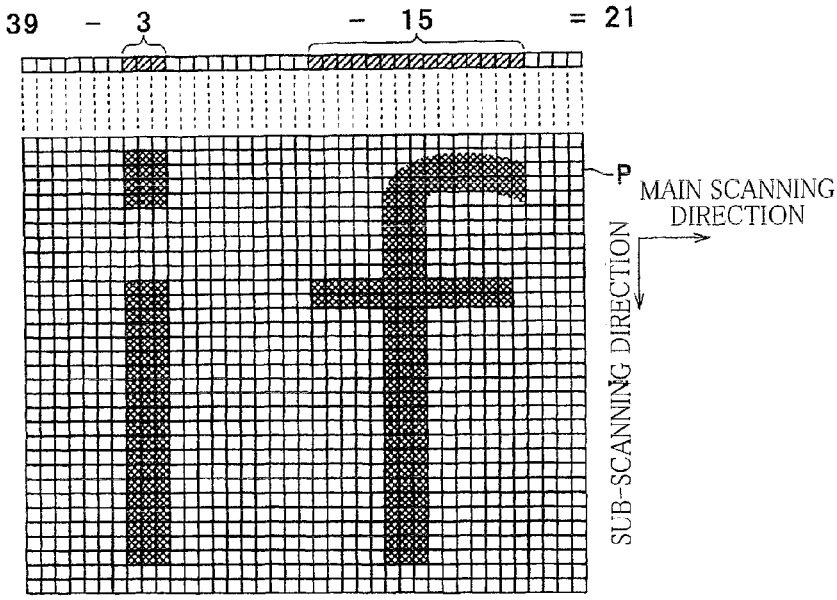
FIGS. 5A, 5B, and 5C are schematic views each for explaining an example of the image recorded on the sheet in the case where the image is rotated 180 degrees.
Figure 5B:
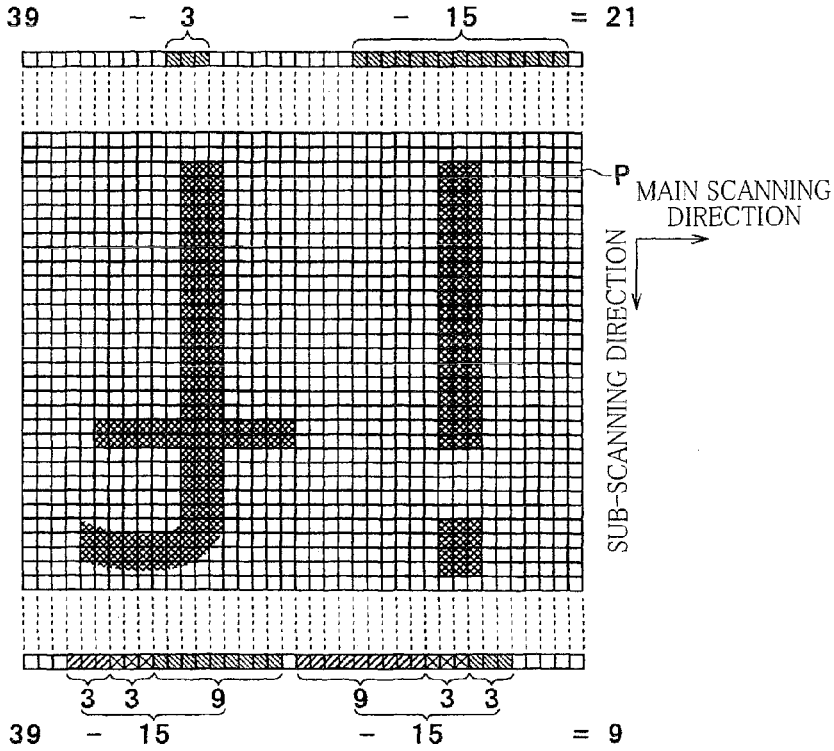

In the present embodiment, the converting section 106 converts the drive data such that an image position adjustment in which the image on the sheet P is rotated 180 degrees is performed for the image to be recorded on the sheet P by the ejection of the ink droplets from the heads 2. FIG. 5A is the same as FIG. 3A and shows a state in which the word or the image "if" is recorded on the sheet P on the basis of the drive data which has not been converted by the converting section 106. Further, FIG. 5B shows a state in which the word "if" shown in FIG. 5A is rotated 180 degrees.

For example, where the word "if" shown in FIG. 5A is recorded on the sheet P, the first ejection-opening extracting section 108 extracts twenty-one ink-ejection openings from which the ink is not ejected, that is, the first ejection-opening extracting section 108 extracts white-colored boxes of thirty-nine boxes located on an upper portion of FIG. 5A. Where the word "if" rotated 180 degrees shown in FIG. 5B is recorded on the sheet P, the second ejection-opening extracting section 109 extracts nine ink-ejection openings from which the ink is not ejected, that is, the second ejection-opening extracting section 109 extracts white-colored boxes of thirty-nine boxes located on an upper portion of FIG. 5B. The ink-ejection controlling section 102 specifies nine (39–15–15) white-colored boxes of thirty-nine boxes located on a lower portion of FIG. 5B. It is noted that each white-colored box represents the ink-ejection opening extracted twice.

Figure 5C:
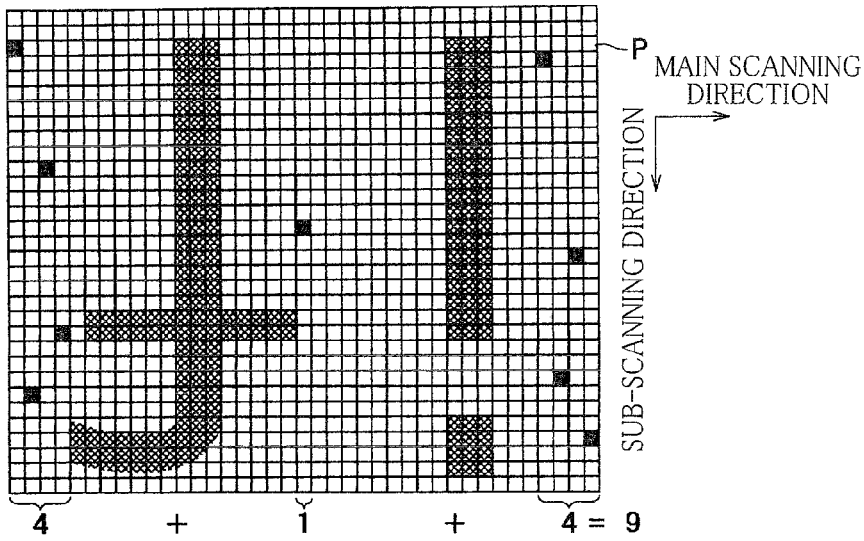

Further, the ink-ejection controlling section 102 superposes (a) nine pixel rows respectively corresponding to the specified nine white-colored boxes in the flashing pattern stored in the flashing-pattern storage section 105 and (b) the converted drive data converted by the converting section 106. As a result, an ink-ejection pattern shown in FIG. 5C is produced. The ink-ejection pattern shown in FIG. 5C includes the word "if" rotated 180 degrees. In the ink-ejection pattern, each of the nine pixel rows respectively corresponding to the specified nine white-colored boxes includes one preliminary ejection pixel. Each preliminary ejection pixel is located at the same position as the preliminary-ejection candidate pixel of a corresponding one of the pixel rows in the flashing pattern shown in FIG. 5C. The ink-ejection controlling section 102 controls the ink ejection of each head 2 on the basis of modified drive data obtained by this superposing operation. As a result, as shown in FIG. 5C, the word "if" rotated 180 degrees and nine (4+1+4) preliminary ejection dots are recorded on the sheet P of the even number.

Figure 6:
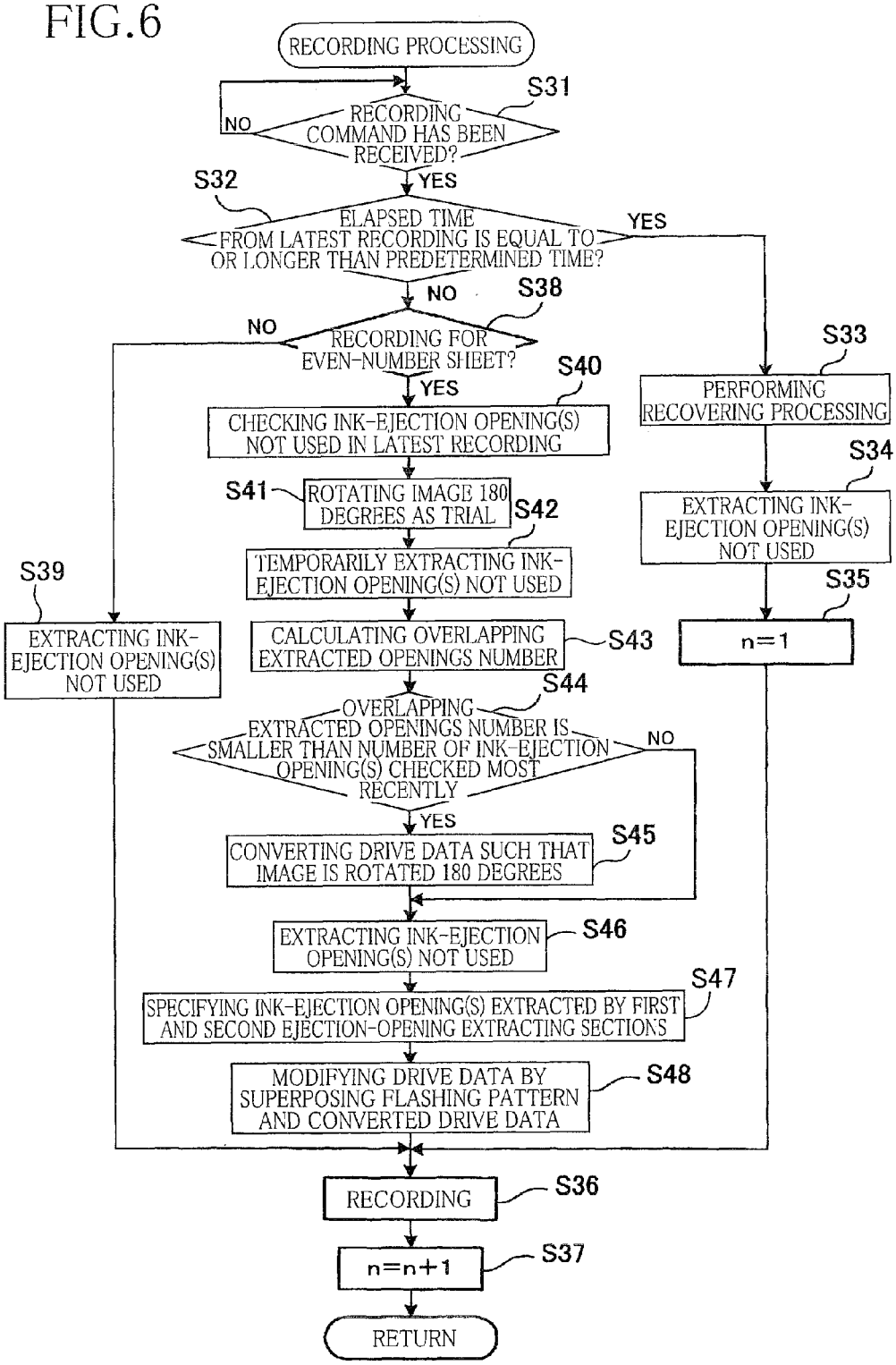
FIG. 6 is a flow-chart showing the recording processing performed by the ink-jet printer shown in FIG. 1 in the case where the image is rotated 180 degrees.

There will be next explained, with reference to a flow-chart in FIG. 6, a recording processing in which operations relating to the image recording are performed by the printer 1 as the present embodiment. It is noted that a detailed explanation of the processing or the step the same as that in the flow-chart in FIG. 4 will be dispensed with.

Initially, in S31, the controller 101 of the printer 1 repeatedly judges whether the controller 101 has received a recording command from the PC 100 or not and/or whether there is any sheet not subjected to the recording on the basis of a recording command received before or not. In S32, the controller 101 judges whether the elapsed time stored in the elapsed-time storage section 110 is equal to or longer than the predetermined length of time or not. Where the controller 101 has judged that the elapsed time is equal to or longer than the predetermined length of time (S32: YES), this recording processing goes to S33. In S33, the controller 101 performs the recovering processing of the heads 2. In S34, the first ejection-opening extracting section 108 extracts the ink-ejection opening(s) each of which is not to be used for the ejection of the ink droplets in the next image recording to be performed on one sheet P, on the basis of the drive data which has not been converted by the converting section 106. The result of the extraction is stored into the memory in the controller 101.

Then, in S35, the count value of the sheet counter 111 is initialized to one. Then, in S36, the ink-ejection controlling section 102 controls the ejection of the ink droplets from each head 2 on the basis of the drive data having not been converted by the converting section 106. As a result, the image "if" not rotated 180 degrees shown in FIG. 5A is recorded on the sheet P, for example. Then, in S37, the count value of the sheet counter 111 is incremented by one, and this recording processing returns to S31.

Where the controller 101 has judged that the elapsed time is shorter than the predetermined length of time (S32: NO), this recording processing goes to S38. In S38, the controller 101 judges whether the current count value of the sheet counter 111 is the even number or the odd number. Where the controller 101 has judged that the current count value of the sheet counter 111 is the odd number (S38: NO), this recording processing goes to S39.

In S39, the processing the same as that of S34 is performed. Then, in S36, the image recording is performed on one sheet P on the basis of the drive data having not been converted by the converting section 106, and then this recording processing returns to S39 after performing S37.

Where the controller 101 has judged that the current count value of the sheet counter 111 is the even number (S38: YES), this recording processing goes to S40. In S40, the controller 101 checks, on the basis of the extractions in S34 or S39, the ink-ejection opening(s) from each of which no ink droplets have been ejected in the latest image recording on one sheet P.

Then, in S41, the preliminary checking section 107 rotates the image 180 degrees as a trial. Specifically, like the operation of the converting section 106, the preliminary checking section 107 converts the drive data stored in the drive-data storage portion 104 such that the image is rotated 180 degrees. Further, in S42, the preliminary checking section 107 temporarily extracts the ink-ejection opening(s) not to be used for the ejection of the ink droplets in the image position adjustment in which the image has been rotated 180 degrees as a trial in S41. Then, in S43, the converting section 106 calculates the number of the ink-ejection opening(s) which is or are the ink-ejection opening(s) checked in S40 and which is or are the ink-ejection opening(s) temporarily extracted in S42 (i.e., the overlapping extracted openings number).

In S44, the preliminary checking section 107 judges whether the overlapping extracted openings number calculated in S43 is smaller than the number of the ink-ejection opening(s) which has or have been checked in S40 or not. Then, where these conditions are satisfied (S44: YES), this recording processing goes to S45. On the other hand, where the above-described conditions are not satisfied (S44: NO), the drive data is not converted, and this recording processing goes to S46.

In S45, the converting section 106 converts the drive data stored in the drive-data storage portion 104 such that the image position adjustment in which the image is rotated 180 degrees is performed. It is noted that the conversion of the drive data by the converting section 106 is performed such that the amount of the ink droplets to be ejected from each of the ink-ejection openings formed in the ink-ejection surface 2*a* of each head 2 is adjusted in correspondence with the 180-degree rotation of the image in order to perform the image position adjustment with the 180-degree rotation of the image. More specifically, the conversion of the drive data is performed such that the amount of the ink droplets ejected from each ink-ejection opening on the basis of the drive data having not been converted becomes the amount of the ink from a corresponding one of the ink-ejection openings which is located at a position symmetrical to that of each ink-ejection opening with respect to a midpoint of a corresponding one of the ink-ejection surfaces 2*a* in the main scanning direction, and a timing of the ink-ejection becomes a corresponding timing which is based on the 180-degree rotation of the image.

Then, in S46, the second ejection-opening extracting section 109 extracts the ink-ejection opening(s) not to be used for the ejection of the ink droplets in the next image recording to be performed on one sheet P, on the basis of the converted drive data having been converted by the converting section 106 in S45.

Further, in S47, the ink-ejection controlling section 102 specifies the overlapping extracted ink-ejection opening(s) which is or are the ink-ejection opening(s) extracted in S34 or S39 by the first ejection-opening extracting section 108 in the latest image recording on one sheet P and which is or are also the ink-ejection opening(s) extracted in S46 by the second ejection-opening extracting section 109 in the next image recording on one sheet P. Identification data of the specified overlapping extracted ink-ejection opening(s) is written into the memory in the controller 101.

In S48, the ink-ejection controlling section 102 modifies the drive data converted by the converting section 106 in S45. Specifically, the ink-ejection controlling section 102 superposes (a) the pixel row(s) each including the overlapping extracted ink-ejection opening(s) specified in S47 in the flashing pattern stored in the flashing-pattern storage section 105 and (b) the converted drive data converted by the converting section 106 in S45. As a result, as described above, the ink-ejection pattern shown in FIG. 5C is produced. Then, in S36, the image recording is performed on one sheet P on the basis of the modified drive data modified in S48, then, in S37, the count value of the sheet counter 111 is incremented by one, and this recording processing returns to S31.

According to the present embodiment, the ink-jet printer 1 not only performs the ink ejection on the basis of the drive data not subjected to the conversion of the 180-degree rotation by the converting section 106, but also performs the ink ejection on the basis of the drive data subjected to the conversion of the 180-degree rotation by the converting section 106, thereby reducing the number of the ink-ejection openings in each of which the preliminary ejection needs to be performed. As a result, the amount of the ink required for the preliminary ejection can be reduced while restraining the ink-ejection failure by performing the preliminary ejection.

Further, in the present embodiment, unlike in the first embodiment, the preliminary checking section 107 does not preliminarily check the present or absence of the ejection of the ink from the ink-ejection openings, for the plurality of the shift amounts. Thus, the operation of the preliminary checking section 107 can be completed in a relatively short time, whereby the recording processing can be speedily performed.

Third Embodiment

There will be next explained a third embodiment of the present invention. In the present embodiment, the shift of the image in the main scanning direction in the first embodiment is replaced with "the shift" and "the shift and the 180-degree rotation". An overall construction of a printer in the present embodiment is the same as that in the above-described first embodiment. Thus, in the explanation of the present embodiment, the same reference numerals used in the first embodiment may be used for elements included in the printer in the present embodiment. Further, like in the first embodiment, the controller 101 functions as the ink-ejection controlling section 102, the sheet-feed controlling section 103, the drive-data storage portion 104, the flashing-pattern storage section 105, the converting section 106, the preliminary checking section 107, the first ejection-opening extracting section 108, the second ejection-opening extracting section 109, the elapsed-time storage section 110, the sheet counter 111, and so on. The flashing-pattern storage section 105 stores the flashing pattern the same as that shown in FIG. 3C. Each of the ink-ejection controlling section 102, the sheet-feed controlling section 103, the drive-data storage portion 104, the first ejection-opening extracting section 108, the second ejection-opening extracting section 109, the elapsed-time storage section 110, and the sheet counter 111 has functions the same as those in the first embodiment.

In the present embodiment, the converting section 106 converts the drive data such that an image position adjustment which is at least one of (a) the shift of the image in the main scanning direction in the sheet P in units of the distance corresponding to the first resolution and (b) the 180-degree rotation of the image in the sheet P is performed for the image to be recorded on the sheet P by the ejection of the ink droplets from the heads 2.

Figure 7:
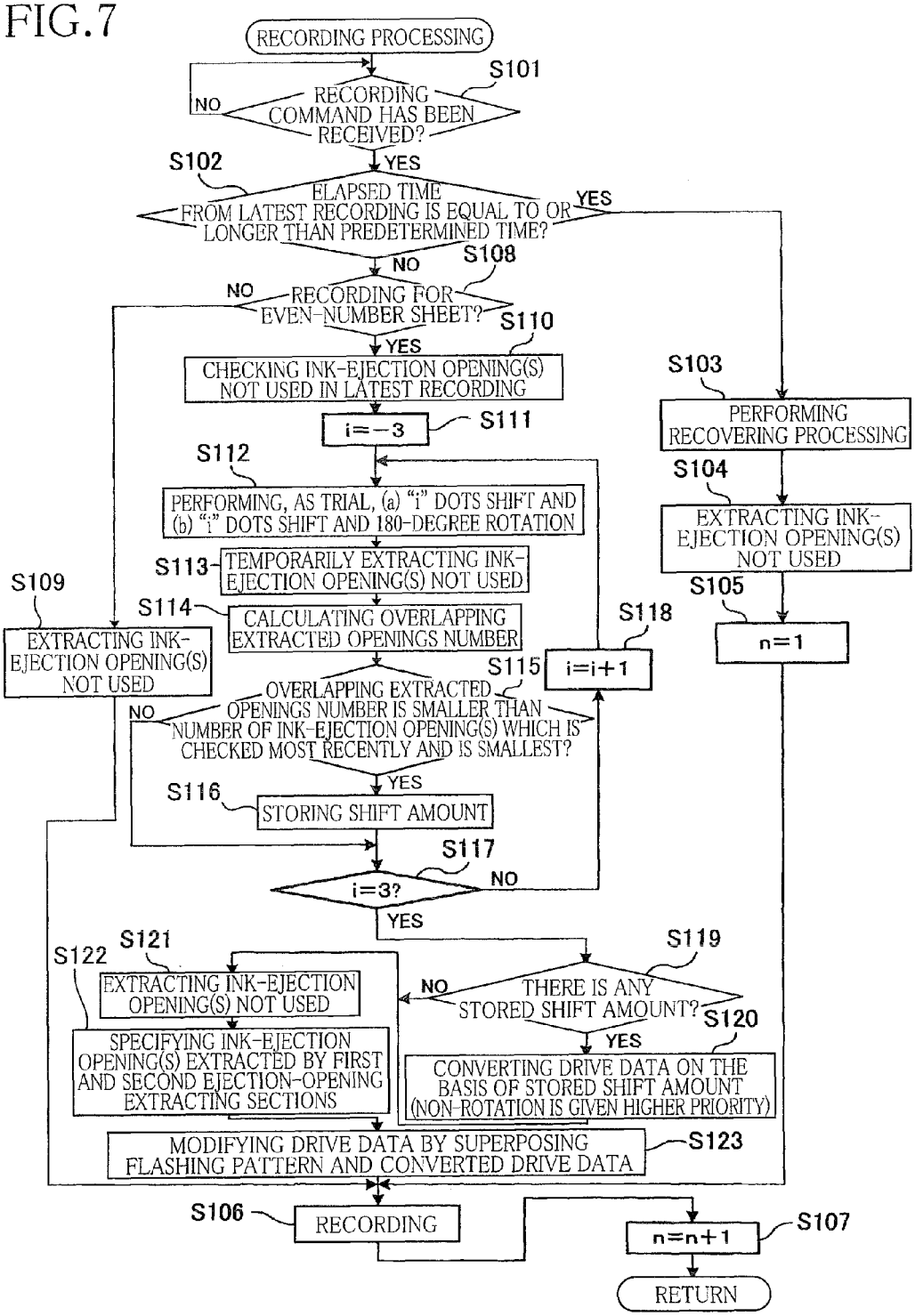
FIG. 7 is a flow-chart showing the recording processing performed by the ink-jet printer shown in FIG. 1 in the case where the image is shifted and rotated 180 degrees.

There will be next explained, with reference to a flow-chart in FIG. 7, a recording processing in which operations relating to the image recording are performed by the printer 1 as the present embodiment. A numeral representing each step shown in FIG. 7 is a number obtained by adding a number of a corresponding one of the steps shown in FIG. 4 by 100. As seen by comparing the flow-charts in FIGS. 4 and 7, only S112 and S120 in the flow-chart shown in FIG. 7 are respectively different from the corresponding steps in the flow-chart shown in FIG. 4. Thus, there will be hereinafter mainly explained these two steps, and an explanation of the other steps will be dispensed with.

In S112, the preliminary checking section 107 performs, as a trial, (a) the shift of the image by the "i" dots and (b) the shift of the image by the "i" dots and the 180-degree rotation of the image. The shift of the image by the "i" dots is the same as that explained in S12 in the first embodiment. The shift of the image by the "i" dots and the 180-degree rotation of the image are combination of the operation explained in S12 in the first embodiment and the operation explained in S41 in the second embodiment. The rotation is performed after the shift in this explanation, but the order of these operations may be reversed. Each of the processings of S113, S114, S115, and S116 is independently performed for each of these two trials. It is noted that, the storage of all the shift amounts in S116 includes two patterns, namely, the case in which only the shift amount is stored and the case in which the combination of the shift amount and the 180-degree rotation is stored. Of course, where the preliminary checking section 107 has newly found a smaller overlapping extracted openings number, "the shift amount" or "the shift amount and the 180-degree rotation" corresponding to this newly found overlapping extracted openings number is or are overwritten and stored. In this time, where conditions defined in S115 are satisfied, a plurality of "the shift amounts" or a plurality of "the shift amounts and the 180-degree rotations" whose smaller overlapping extracted openings number are the same as each other are all stored.

In S120, the converting section 106 converts the drive data stored in the drive-data storage portion 104 such that the image position adjustment according to the stored shift amount (which means the above-described two patterns here) is performed. However, where the plurality of the shift amounts are stored, the converting section 106 converts the drive data such that the performance of the image position adjustment with only the shift is given a higher priority among a plurality of the image position adjustments according to the plurality of the stored shift amounts. That is, where the image position adjustment in which the overlapping extracted openings number becomes the smallest includes the adjustment with only the shift and the adjustment with both of the shift and the 180-degree rotation, the converting section 106 converts the drive data such that the image position adjustment with only the shift is performed. As a result, the percentage of the sheets P on each of which the image rotated 180 degrees is recorded is decreased, which can facilitate handling of the recorded sheets P. Further, the plurality of the shift amounts are stored upon the image position adjustment with only the shift, the converting section 106 selects the smallest shift amount.

Figure 8:
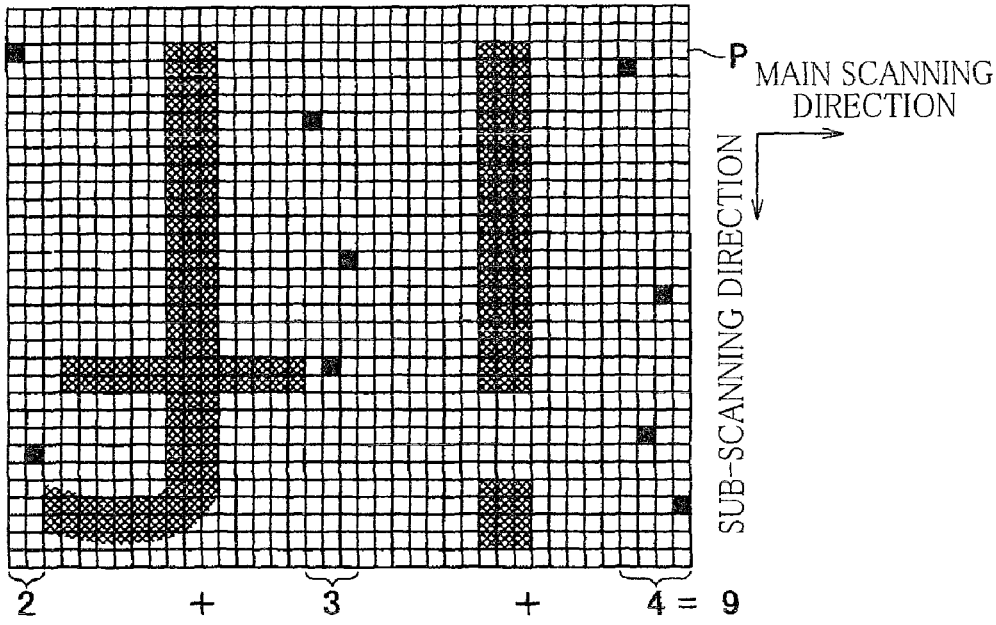
FIG. 8 is a schematic view for explaining an example of the image recorded on the sheet in the case where the image is shifted and rotated 180 degrees.

For reference purposes, FIG. 8 shows an ink-ejection pattern which includes a word "if" shifted by +2 dots and rotated 180 degrees and in which each of nine pixel rows respectively corresponding to specified nine white-colored boxes includes one preliminary ejection pixel.

According to the present embodiment, the ink-jet printer 1 not only performs the ink ejection on the basis of the drive data having not been converted by the converting section 106, but also performs the ink ejection on the basis of the drive data subjected to the conversion of "the shift" or "the shift and the 180-degree rotation" by the converting section 106, thereby reducing the number of the ink-ejection openings in each of which the preliminary ejection needs to be performed. As a result, the amount of the ink required for the preliminary ejection can be reduced while restraining the ink-ejection failure by performing the preliminary ejection. Especially in the present embodiment, since the image position adjustment can be performed with both of the shift and the 180-degree rotation, it is possible to increase a possibility that the amount of the ink required for the preliminary ejection can be further reduced. It is noted that, as a modification of the present embodiment, the preliminary checking section 107 may perform in S112 only the shift of the image by the "i" dots not excluding the case of "i=0" and the 180-degree rotation of the image as a trial.

While the embodiments of the present invention have been described above, it is to be understood that the invention is not limited to the details of the illustrated embodiments, but may be embodied with various changes and modifications, which may occur to those skilled in the art, without departing from the spirit and scope of the invention. For example, the controller 101 includes the preliminary checking section 107 in the above-described three embodiments, but this preliminary checking section 107 may be omitted. In this case, the converting section 106 converts the drive data such that the image position adjustment is performed with the shift by a predetermined fixed shift amount.

Further, the ink-jet printer 1 may be configured such that the controller 101 does not include the flashing-pattern storage section 105. In this case, the ink-ejection controlling section 102 determines the positions of the preliminary ejection pixels by calculation as appropriate.

The drive data may be data previous to the data (e.g., image data produced in a general format such as JPEG) representing, in each recording period, the amount of the ink to be ejected from each ink-ejection opening in correspondence with the image to be recorded. In this case, after converting the drive data, the converting section 106 converts the data to the data representing, in each recording period, the amount of the ink to be ejected from each ink-ejection opening.

Further, in the above-described three embodiments, each of all the first predetermined number, the second predetermined number, the third predetermined number, and the fourth predetermined number is one, but each of the first predetermined number through the fourth predetermined number may be any number. For example, where each of these numbers is a plural number in the first embodiment, the following steps or processings only need to be changed. That is, in S4 and S9, the number of the ejection of the ink droplets from each ink-ejection opening is extracted. Then, in S10, the ink-ejection opening(s) whose number of the ejection of the ink droplets is smaller than the second predetermined number among the plurality of ink-ejection openings is or are extracted upon the latest image recording on the sheets P of the first predetermined number on the basis of the drive data having been not converted. Further, in S13 and S21, the ink-ejection opening(s) whose number of the ejection of the ink droplets is smaller than the fourth predetermined number among the plurality of ink-ejection openings is or are extracted during the image recording on the sheet P of the third predetermined number on the basis of the converted drive data having been converted.

The ink-jet printer 1 may be configured such that, where each of the first predetermined number and the third predetermined number is a plural number, the image recording is successively performed on the sheets P of the first predetermined number, and the image recording is successively performed on the sheets P of the third predetermined number. As a result, the control of the ink-ejection can be simplified. Here, the word "successively" means that the image recording on the sheets P of the first predetermined number and the image recording on the sheets P of the third predetermined number are not mixed. As another modification, the ink-jet printer 1 may be configured such that these image recordings are mixed, that is, at least part of the image recording on the sheets P of the third predetermined number during the image recording on the sheets P of the first predetermined number.

In this time, it is preferable that the image recording is successively performed on the sheets P of the third predetermined number after the image recording has been successively performed on the sheets P of the first predetermined number. As a result, it is possible to apply the present invention to the ink-jet printer 1 also in the case where a recording command for the image recording on the sheet P of the third predetermined number has been received after the image recording on the sheets P of the first predetermined number is completed.

In the above-described three embodiments, the preliminary ejection is performed on the sheet P when the image recording is performed on the basis of the converted drive data, but the preliminary ejection may be performed on the sheet P when the image recording is performed on the basis of the drive data having not been converted. Further, the preliminary ejection may be performed on the sheet P at the both of the times when the image recording is performed on the basis of the converted drive data and when the image recording is performed on the basis of the drive data having not been converted. Further, the preliminary ejection may be performed on a plurality of the sheets P. Further, the preliminary ejection may be performed twice or more from one of the ink-ejection openings when the image recording is performed on the sheet P of the third predetermined number on the basis of the drive data having not been converted. This configuration is realized by providing two or more preliminary-ejection candidate pixels in each pixel row in the flashing pattern shown in FIG. 3C, for example.

In the above-described three embodiments, the image recording on the sheet P of the third predetermined number is performed on the basis of the converted drive data after the image recording on the sheet P of the first predetermined number has been performed on the basis of the drive data having not been converted. However, the order of these image recordings may be reversed. These can be said that the image recording on the sheet P of the third predetermined number on the basis of the drive data having been converted is performed before or after the image recording on the sheet P of the first predetermined number on the basis of the drive data which has not been converted. This means that either one of the image recording on the sheet P of the first predetermined number and the image recording on the sheet P of the third predetermined number may be performed first, and includes that the image recording on the sheet P of the first predetermined number and the image recording on the sheet P of the third predetermined number are mixed. That is, the image recording on the sheet P of the first predetermined number may be performed on the basis of the drive data having not been converted after the image recording on the sheet P of the third predetermined number has been performed on the basis of the converted drive data. Also in this case, the preliminary ejection may be performed on any one or more of the sheets P.

In the above-described embodiments, the preliminary check is performed in ascending order of the shift amounts, namely, −3, −2, −1, 0, +1, +2, and +3 dots, but the preliminary check may be performed in descending order of the shift amounts. In this case, whether the order of the preliminary check is set to the ascending order or the descending order may be set by a user in advance. Further, where a negative decision is made in S19 (S19: NO), the second ejection-opening extracting section 109 extracts in S21 the ink-ejection opening(s), and then the ink-ejection controlling section 102 specifies in S22 the ink-ejection opening(s) extracted by the first ejection-opening extracting section 108 and the second ejection-opening extracting section 109, but the ink-jet printer 1 may be configured such that the processings of S21 and S22 are omitted, and the ink-ejection controlling section 102 refers the data about the ink-ejection openings loaded in S10 (the result of the extraction of the ink-ejection opening(s) by the first ejection-opening extracting section 108) to superpose in S23 the data and the flashing pattern.

In the first embodiment, since the preliminary checking section 107 performs the preliminary check using the seven levels of the shift amounts (i.e., −3, −2, −1, 0, +1, +2, and +3 dots), a desired shift amount can be designated as appropriate even where the images recorded on the sheets P are the same as each other or different from each other. However, where the images the same as each other are recorded, the preliminary checking section 107 may perform the preliminary check for six levels of the shift amounts which exclude the shift amount "0" from the seven levels, from the viewpoint of simplification of the processing.

Further, in the first embodiment, the preliminary checking section 107 stores in S16 all the shift amount(s) in which the overlapping extracted openings number becomes the smallest, but the shift amount(s) may be sequentially overwritten in the memory in the controller 101 in accordance with the progress of the preliminary check from the viewpoint of simplification of the processing.

Where a negative decision is made in S44 (S44: NO), the second ejection-opening extracting section 109 extracts in S46 the ink-ejection opening(s), and then the ink-ejection controlling section 102 specifies in S47 the ink-ejection opening(s) extracted by the first ejection-opening extracting section 108 and the second ejection-opening extracting section 109, but the ink-jet printer 1 may be configured such that the processings of S46 and S47 are omitted, and the ink-ejection controlling section 102 refers the data about the ink-ejection openings loaded in S40 (the result of the extraction of the ink-ejection opening(s) by the first ejection-opening extracting section 108) to superpose in S48 the data and the flashing pattern.

Further, in any of the embodiments, it has been explained that the recording area and the preliminary ejection area coincide with each other, but these areas does not need to coincide with each other. For example, the preliminary ejection area can be set to any area in the recording area.

It is noted that, in the first embodiment, the converting section 106 converts the drive data such that the image position adjustment with the shift only in the main scanning direction is performed, but the converting section 106 can convert the drive data such that the image position adjustment with a shift in the sub-scanning direction. For example, the converting section 106 may convert the drive data such that the image is shifted by +1 or −1 dot in the sub-scanning direction in the second resolution at the same time when the image is shifted by +3 dots in the main scanning direction. In this case, the converting section 106 shifts the image in the main scanning direction and the sub-scanning direction, but, from the viewpoint of reducing the ink required for the preliminary ejection, the image only needs to be shifted in the main scanning direction, and thus whether the image is shifted in the sub-scanning direction or not may be appropriately set as required. Further, in the second embodiment, the converting section 106 converts the drive data such that the image position adjustment with the 180-degree rotation of the image is performed, but an angle of the rotation of the image is not limited to 180 degrees. For example, the converting section 106 may convert the drive data such that an image position adjustment with one-degree rotation of the image is performed and may convert the drive data such that an image position adjustment with 179-degree rotation of the image is performed. The conversion of the drive data by the converting section 106 is not limited to the image position adjustment with the shift in the main scanning direction and/or the rotation of the image as long as the user does not feel discomfort or uncomfortable when viewing the image. That is, in the case where the image position adjustment is performed such that the position of the image to be recorded on the sheet P on the basis of the drive data having been converted is changed in the main scanning direction with respect to the image to be recorded on the sheet P on the basis of the drive data having not been converted, the image position adjustment by the conversion of the drive data by the converting section 106 may reduce the ink required for the preliminary ejection. A manner of the image position adjustment can be appropriately selected as required.

Further, in view of the above, the controller 101 can be considered to include a drive-data converting section configured to convert the drive data such that the image position adjustment in which the position of the image formed on the sheet P by the ink ejected from the head 2 on the basis of the drive data which has been converted is changed in the main scanning direction with respect to the image formed on the sheet P by the ink ejected from the head 2 on the basis of the drive data which has not been converted, and this drive-data converting section can be considered to perform the processings of S20, S45, and S120. Further, in view of the above, the controller 101 can be considered to include a first ejection-opening extracting section configured to extract at least one ink-ejection opening whose number of ejections of the ink during the recording of the image on at least one sheet P of the first predetermined number on the basis of the drive data which has not been converted by the drive-data converting section is smaller than the second predetermined number among the plurality of ink-ejection openings, and this first ejection-opening extracting section can be considered to perform the processings of S4 and S9. Further, in view of the above, the controller 101 can be considered to include a second ejection-opening extracting section configured to extract at least one ink-ejection opening whose number of ejections of the ink during the recording of the image on at least one sheet P of the third predetermined number on the basis of the drive data which has been converted by the drive-data converting section is smaller than the fourth predetermined number among the plurality of ink-ejection openings, the recording of the image being performed successively before or successively after the recording of the image on the at least one sheet P of the first predetermined number, and this second ejection-opening extracting section can be considered to perform the processing of S21. Further, in view of the above, the controller 101 can be considered to include an ejection controller configured to control the ejection of the ink from the head 2 such that at least one preliminary ejection of the ink from at least one of ink-ejection opening extracted by both of the first ejection-opening extracting section and the second ejection-opening extracting section is performed upon recording of the image on at least one of the sheets P which is subjected to both of the recording of the image on the at least one sheet P of the first predetermined number on the basis of the drive data which has not been converted by the drive-data converting section and the recording of the image on the at least one sheet P of the third predetermined number on the basis of the drive data which has been converted by the drive-data converting section, and this ejection controller can be considered to perform the processing of S23.

What is claimed is:

1. An image recording apparatus comprising:

a liquid-ejection head in which formed a plurality of liquid-ejection openings which are arranged in a first direction and through each of which liquid is ejected onto a recording medium;

a moving mechanism configured to move the recording medium relative to the liquid-ejection head in a second direction which is perpendicular to the first direction;

a drive-data storage portion configured to store drive data based on which the liquid-ejection head is driven;

a drive-data converting section configured to convert the drive data such that an image position adjustment in which a position of an image formed on the recording medium by the liquid ejected from the liquid-ejection head on the basis of the drive data which has been converted is changed in the first direction with respect to an image formed on the recording medium by the liquid ejected from the liquid-ejection head on the basis of the drive data which has not been converted;

a first ejection-opening extracting section configured to extract at least one liquid-ejection opening whose number of ejections of the liquid during the recording of the image on at least one recording medium of a first predetermined number on the basis of the drive data which has not been converted by the drive-data converting section is smaller than a second predetermined number among the plurality of liquid-ejection openings;

a second ejection-opening extracting section configured to extract at least one liquid-ejection opening whose number of ejections of the liquid during the recording of the image on at least one recording medium of a third predetermined number on the basis of the drive data which has been converted by the drive-data converting section is smaller than a fourth predetermined number among the plurality of liquid-ejection openings, the recording of the image being performed successively before or successively after the recording of the image on the at least one recording medium of the first predetermined number; and an ejection controller configured to control the ejection of the liquid from the liquid-ejection head such that at least one preliminary ejection of the liquid from at least one liquid-ejection opening extracted by both of the first ejection-opening extracting section and the second ejection-opening extracting section is performed upon recording of the image on at least one of a plurality of the recording media which is subjected to both of the recording of the image on the at least one recording medium of the first predetermined number on the basis of the drive data which has not been converted by the drive-data converting section and the recording of the image on the at least one recording medium of the third predetermined number on the basis of the drive data which has been converted by the drive-data converting section, wherein the liquid-ejection head is configured such that the plurality of liquid-ejection openings are formed in the first direction at a predetermined resolution, and wherein the drive-data converting section is configured to convert the drive data stored in the drive-data storage portion such that the image position adjustment becomes at least one of (a) a shift of the image in the recording medium in the first direction in units of a distance corresponding to the predetermined resolution and (b) 180-degree rotation of the image in the recording medium.

2. The image recording apparatus according to claim 1, wherein the drive-data converting section is configured to convert the drive data such that an amount of the liquid ejected from each of the plurality of liquid-ejection openings is adjusted.

3. The image recording apparatus according to claim 1, wherein the drive-data converting section is configured to convert the drive data such that, where the image position adjustment is the shift of the image in the first direction, an amount of the liquid ejected from each of the plurality of liquid-ejection openings is adjusted in correspondence with a shift amount of the image in the first direction.

4. The image recording apparatus according to claim 3, wherein the liquid-ejection head is configured to eject the liquid through the plurality of liquid-ejection openings on a cycle which corresponds to the movement of the recording medium by the moving mechanism in the second direction, and wherein the drive-data converting section is configured to convert the drive data such that the amount of the liquid ejected from each of the plurality of liquid-ejection openings becomes, on each cycle, an amount of the liquid ejected from a corresponding one of the plurality of liquid-ejection openings shifted by the shift amount in the first direction of the liquid-ejection head.

5. The image recording apparatus according to claim 1, wherein the drive-data converting section is configured to convert, where the image position adjustment is the 180-degree rotation of the image, the drive data such that an amount of the liquid ejected from each of the plurality of liquid-ejection openings is adjusted in correspondence with the 180-degree rotation of the image.

6. The image recording apparatus according to claim 5, wherein the liquid-ejection head is configured to eject the liquid through the plurality of liquid-ejection openings on a cycle which corresponds to the movement of the recording medium by the moving mechanism in the second direction, and wherein the drive-data converting section is configured to convert the drive data such that the amount of the liquid ejected from each of the plurality of liquid-ejection openings becomes an amount of the liquid from a corresponding one of the liquid-ejection openings which is located at a position symmetrical to that of said each liquid-ejection opening with respect to a midpoint of the liquid-ejection head in the first direction, and a timing of the ejection of the liquid becomes a corresponding timing which is based on the 180-degree rotation of the image.

7. The image recording apparatus according to claim 1, further comprising a preliminary checking section configured to preliminarily check the number of ejections of the liquid from each of the liquid-ejection openings in each of a plurality of the shifts whose shift amounts in the first direction are different from each other, wherein the drive-data converting section is configured to convert the drive data stored in the drive-data storage portion on the basis of a result of a preliminary check performed by the preliminary checking section such that the image position adjustment is performed with the shift having a shift amount in which the number of the at least one liquid-ejection opening extracted by both of the first ejection-opening extracting section and the second ejection-opening extracting section becomes the smallest.

8. The image recording apparatus according to claim 7, wherein the drive-data converting section is configured to convert the drive data stored in the drive-data storage portion such that, where, as a result of the preliminary check performed by the preliminary checking section, there are a plurality of the image position adjustments whose shift amounts are different from each other and in each of which the number of the at least one of the liquid-ejection openings that is extracted by both of the first ejection-opening extracting section and the second ejection-opening extracting section becomes the smallest, an image position adjustment is performed with the shift whose shift amount is the smallest among the plurality of the image position adjustments.

9. The image recording apparatus according to claim 1, further comprising a preliminary checking section configured to preliminarily check the number of ejections of the liquid from each of the liquid-ejection openings in each of the 180-degree rotation with the shift and a plurality of the shifts whose shift amounts in the first direction are different from each other, wherein the drive-data converting section is configured to convert the drive data stored in the drive-data storage portion such that, where, as a result of the preliminary check performed by the preliminary checking section, there are a plurality of the image position adjustments in each of which the number of the at least one of the liquid-ejection openings that is extracted by both of the first ejection-opening extracting section and the second ejection-opening extracting section becomes the smallest, an image position adjustment only with the shift among the plurality of the image position adjustments is performed with a higher priority.

10. The image recording apparatus according to claim 1, wherein the drive-data converting section is configured to convert the drive data stored in the drive-data storage portion such that both of the shift and the 180-degree rotation are performed as the image position adjustment.

11. The image recording apparatus according to claim 1, wherein the recording of the image on the at least one recording medium of the first predetermined number is successively performed, and the recording of the image on the at least one recording medium of the third predetermined number is successively performed.

12. The image recording apparatus according to claim 11, wherein the recording of the image on the at least one recording medium of the third predetermined number is successively performed after the recording of the image on the at least one recording medium of the first predetermined number is successively performed.

13. The image recording apparatus according to claim 1, wherein the preliminary ejection is performed only where a length of time elapsed from a time at which the recording of the image on the recording medium is finished is shorter than a predetermined length of time.

14. The image recording apparatus according to claim 1, wherein the preliminary ejection is performed when the image is recorded on the at least one recording medium of the third predetermined number.

15. The image recording apparatus according to claim 1, wherein each of the second predetermined number and the fourth predetermined number is one.

* * * * *